US008344972B2

(12) United States Patent
Kimura

(10) Patent No.: US 8,344,972 B2
(45) Date of Patent: Jan. 1, 2013

(54) LIGHT EMITTING DEVICE AND ELECTRONIC DEVICE

(75) Inventor: Hajime Kimura, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 13/423,176

(22) Filed: Mar. 17, 2012

(65) Prior Publication Data

US 2012/0229015 A1 Sep. 13, 2012

Related U.S. Application Data

(60) Continuation of application No. 12/906,505, filed on Oct. 18, 2010, now Pat. No. 8,139,000, which is a continuation of application No. 11/404,953, filed on Apr. 14, 2006, now Pat. No. 7,817,116, which is a division of application No. 09/992,569, filed on Nov. 6, 2001, now Pat. No. 7,030,847.

(30) Foreign Application Priority Data

Nov. 7, 2000 (JP) ..... 2000-339752

(51) Int. Cl.
*G09G 3/00* (2006.01)

(52) U.S. Cl. ..... 345/76; 345/82; 345/204; 315/169.3

(58) Field of Classification Search ..... 345/76, 345/82, 204; 315/169.3; 313/500; 348/800, 348/801; 257/83
See application file for complete search history.

(56) References Cited

U.S. PATENT DOCUMENTS

| | | | |
|---|---|---|---|
| 5,576,857 | A | 11/1996 | Takemura |
| 5,714,968 | A | 2/1998 | Ikeda |
| 5,731,795 | A | 3/1998 | Kanda et al. |
| 5,818,068 | A | 10/1998 | Sasaki et al. |
| 5,888,858 | A | 3/1999 | Yamazaki et al. |
| 5,903,248 | A | 5/1999 | Irwin |
| 5,940,053 | A | 8/1999 | Ikeda |

(Continued)

FOREIGN PATENT DOCUMENTS

EP 1 005 013 A1 5/2000

(Continued)

OTHER PUBLICATIONS

Tsutsui, T., et al, "Electroluminescence in Organic Thin Films," Photochemical Processes in Organized Molecular Systems, 1991, pp. 437-450.

(Continued)

*Primary Examiner* — Abbas Abdulselam
(74) *Attorney, Agent, or Firm* — Husch Blackwell LLP

(57) ABSTRACT

A TFT for controlling the amount of current flowing into a power supply line when an EL element does not emit light (electric discharge TFT) is provided in each pixel. When an EL driving TFT is turned ON to make an EL element emit light, the electric discharge TFT is turned OFF. On the other hand, the electric discharge TFT is turned ON when the EL driving TFT is turned OFF and no EL element emit light. Therefore variation of the difference in electric potential over the length of a power supply line depending on an image to be displayed is contained. Thus reduced is the difference in amount of current flowing into EL elements in adjacent pixels while the EL elements emit light, thereby avoiding crosstalk.

23 Claims, 12 Drawing Sheets

U.S. PATENT DOCUMENTS

| | | | | |
|---|---|---|---|---|
| 5,952,789 | A | 9/1999 | Stewart et al. | |
| 6,011,529 | A | 1/2000 | Ikeda | |
| 6,011,532 | A | 1/2000 | Yanai et al. | |
| 6,091,203 | A | 7/2000 | Kawashima et al. | |
| 6,229,506 | B1 * | 5/2001 | Dawson et al. | 345/82 |
| 6,246,180 | B1 | 6/2001 | Nishigaki | |
| 6,359,605 | B1 | 3/2002 | Knapp et al. | |
| 6,380,688 | B1 | 4/2002 | Bae et al. | |
| 6,384,804 | B1 | 5/2002 | Dodabalapur et al. | |
| 6,486,606 | B1 | 11/2002 | Ting | |
| 6,535,185 | B2 | 3/2003 | Kim et al. | |
| 6,548,960 | B2 | 4/2003 | Inukai | |
| 6,570,338 | B2 | 5/2003 | Bae | |
| 6,611,108 | B2 | 8/2003 | Kimura | |
| 6,628,363 | B1 | 9/2003 | Sano et al. | |
| 6,730,966 | B2 | 5/2004 | Koyama | |
| 6,753,656 | B2 | 6/2004 | Kimura | |
| 6,791,129 | B2 | 9/2004 | Inukai | |
| 6,847,341 | B2 | 1/2005 | Kimura et al. | |
| 7,023,482 | B2 | 4/2006 | Sakuragi | |
| 7,061,451 | B2 | 6/2006 | Kimura | |
| 7,113,154 | B1 | 9/2006 | Inukai | |
| 2001/0002703 | A1 | 6/2001 | Koyama | |
| 2001/0035849 | A1 | 11/2001 | Kimura et al. | |
| 2001/0035863 | A1 | 11/2001 | Kimura | |
| 2002/0000576 | A1 | 1/2002 | Inukai | |
| 2002/0047120 | A1 | 4/2002 | Inukai | |
| 2002/0047555 | A1 | 4/2002 | Inukai | |
| 2002/0113760 | A1 | 8/2002 | Kimura | |

FOREIGN PATENT DOCUMENTS

| | | |
|---|---|---|
| EP | 1 061 497 A1 | 12/2000 |
| JP | 8-54835 | 2/1996 |
| JP | 2000-163015 | 6/2000 |
| JP | 2000-221942 | 8/2000 |
| JP | 2000-235370 | 8/2000 |
| JP | 2000-347621 | 12/2000 |
| JP | 2001-42822 | 2/2001 |
| JP | 2001-60076 | 3/2001 |
| JP | 2002-152565 | 5/2002 |

OTHER PUBLICATIONS

Baldo, M.A. et al, "Highly Efficient Phosphorescent Emission from Organic Electroluminescent Devices," Nature, vol. 395, Sep. 10, 1998, pp. 151-154.

Baldo, M.A. et al, "Very High-Efficiency Green Organic Light-Emitting Devices Based on Electrophosphorescence," Applied Physics Letters, vol. 75, No. 1, Jul. 5, 1999, pp. 4-6.

Tsutsui, T. et al, "High Quantum Efficiency in Organic Light-Emitting Devices with Iridium-Complex as a Triplet Emissive Center," Japanese Journal of Applied Physics, vol. 38, part 2, No. 12B, Dec. 15, 1999, pp. L1502-L1504.

* cited by examiner

LIGHT EMITTING DEVICE AND ELECTRONIC DEVICE

This application is a continuation of U.S. application Ser. No. 12/906,505 filed Oct. 18, 2010 now U.S. Pat. No. 8,139,000 which is a continuation of U.S. application Ser. No. 11/404,953 filed Apr. 14, 2006 (now U.S. Pat. No. 7,817,116 issued Oct. 19, 2010) which is a divisional of U.S. application Ser. No. 09/992,569 filed Nov. 6, 2001 (now U.S. Pat. No. 7,030,847 issued Apr. 18, 2006).

BACKGROUND OF THE INVENTION

1. Field of the Invention

The present invention relates to an EL panel in which an EL element formed on a substrate is sealed between the substrate and a cover member. The invention also relates to an EL module with IC mounted to the EL panel. In this specification, the EL panel and the EL module are generically called light emitting devices. The present invention further relates to an electronic device employing the light emitting devices.

2. Description of the Related Art

Self-light emitting EL elements eliminate the need for a backlight that is necessary in liquid crystal displays (LCDs) and thus make it easy to manufacture thinner displays. Also, the EL elements are high in visibility and have no limit in terms of viewing angle. These are the reasons for attention that light emitting devices using the EL elements have been receiving recently as display devices to replace CRTs and LCDs.

An EL element has a layer containing an organic compound that provides luminescence (electroluminescence) when an electric field is applied (the layer is hereinafter referred to as EL layer), in addition to an anode layer and a cathode layer. Luminescence obtained from organic compounds includes light emission in returning to a base state from singlet excitation (fluorescence) and light emission in returning to a base state from triplet excitation (phosphorescence). A light emitting device according to the present invention can use both types of light emission.

All layers that are provided between an anode and a cathode are an EL layer in this specification. Specifically, the EL layer includes a light emitting layer, a hole injection layer, an electron injection layer, a hole transport layer, an electron transport layer, etc. A basic structure of an EL element is a laminate of an anode, a light emitting layer, and a cathode layered in this order. The basic structure can be modified into a laminate of an anode, a hole injection layer, a light emitting layer, and a cathode layered in this order, or a laminate of an anode, a hole injection layer, a light emitting layer, an electron transport layer, and a cathode layered in this order.

The EL element defined herein is a light emitting element that is composed of an anode, an EL layer, and a cathode. In this specification, an EL element emitting light is expressed as an EL element being driven.

Methods of driving a light emitting device comprising an EL element are roughly divided into analog driving methods and digital driving methods. Digital driving is deemed to be more promising in view of transition from analog broadcasting to digital broadcasting since it enables the light emitting device to display an image using a digital video signal that has image information as it is without converting the signal into an analog signal.

Described below is the structure of a pixel portion in a common light emitting device driven by a time division driving method. The description is given with reference to FIG. 17.

FIG. 17 is a circuit diagram of a pixel portion in a common light emitting device. A pixel portion 9001 has source signal lines S1 to Sx, power supply lines V1 to Vx, and gate signal lines G1 to Gy. The pixel portion 9001 includes a plurality of pixels 9002 that form a matrix.

Each of the pixels 9002 has one of the source signal lines S1 to Sx, one of the power supply lines V1 to Vx, and one of the gate signal lines G1 to Gy. Each of the pixels 9002 also has a switching TFT 9003, an EL driving TFT 9004, and an EL element 9006.

The switching TFT 9003 has a gate electrode connected to one of the gate signal lines G1 to Gy. The switching TFT 9003 has a source region and a drain region, one of which is connected to one of the source signal lines S1 to Sx and the other of which is connected to a gate electrode of the EL driving TFT 9004 and to a capacitor 9005 that is provided in each of the pixels 9002.

The capacitor 9005 is provided to hold the gate voltage (the difference in electric potential between the gate electrode and a source region) of the EL driving TFT 9004 when the switching TFT 9003 is riot selected (when the TFT 9003 is in an OFF state).

The source region of the EL driving TFT 9004 is connected to one of the power supply lines Vi to Vx whereas a drain region thereof is connected to the EL element 9006. The power supply lines V1 to Vx are respectively connected to the capacitors 9005 in the pixels.

The EL element 9006 is composed of an anode, a cathode, and an EL layer placed between the anode and the cathode. If the anode is connected with the drain region of the EL driving TFT 9004, the anode serves as a pixel electrode whereas the cathode serves as an opposite electrode. On the other hand, the cathode serves as the pixel electrode whereas the anode serves as the opposite electrode if the cathode is connected with the drain region of the EL driving TFT 9004.

The opposite electrode of the EL element 9006 is given an electric potential (opposite electric potential) from a power supply external to the EL panel. The power supply lines V1 to Vx are also given an electric potential (power supply electric potential Vp) from a power supply external to the EL panel.

The operation of the pixel portion 9001 shown in FIG. 17 is described next.

A selection signal is inputted to the gate signal line G1 to select the gate signal line G1 and turn every switching TFT 9003 whose gate electrode is connected to the gate signal line G1 ON. In this specification, a signal line being selected means that every TFT whose gate electrode is connected to the signal line is turned ON.

Through the switching TFT 9003 that is turned ON, a digital signal which carries image information (hereinafter the signal is referred to as digital video signal) and which is inputted to the source signal lines S1 to Sx is inputted to the gate electrode of the EL driving TFT 9004.

The digital video signal inputted to the gate electrode of the EL driving TFT 9004 contains information, which is '1' or '0' and used to control switching of the EL driving TFT 9004.

When the EL driving TFT 9004 is turned OFF, the electric potential of the power supply lines V1 to Vx is not given to the pixel electrode of the EL element 9006 and therefore the EL element 9006 does not emit light. On the other hand, when the EL driving TFT 9004 is turned ON, the electric potential of the power supply lines V1 to Vx is given to the pixel electrode of the EL element 9006 to cause the EL element 9006 to emit light.

When the gate signal line G1 is no longer selected, the gate signal line G2 is selected to repeat the operation described above. An image is displayed when the gate signal lines G1 to Gy are sequentially selected until all of them are selected once and the above operation is conducted in every pixel.

In the driving method described above, the power supply electric potential Vp given to each power supply line by the power supply external to the EL panel is given to the source region of the EL driving TFT 9004 of each pixel. Ideally, the same level of electric potential Vp is given to the source region of every EL driving TFT 9004 that is connected to the same power supply line.

In fact, however, a power supply line has its own resistance (wiring line resistance) to make the electric potential vary over the length of the power supply line. Due to the wiring line resistance, the electric potential of a power supply line becomes closer to the electric potential of a ground and the difference from the power supply electrics potential Vp is increased as the distance from the power supply is increased. Accordingly, the electric potential given to the source region of one EL driving TFT 9004 is different from the electric potential given to the source region of another EL driving TFT 9004 depending on the site at which the TFT is connected to the power supply line even though the TFTs are connected to the same power supply line.

The difference in electric potential between different sites of one power supply line is greater when the amount of current flowing into the power supply line is larger. In other words, even though the distance from the power supply is the same, the electric potential difference due to wiring line resistance becomes greater and the electric potential at the site becomes much closer to the electric potential of a ground than the power supply electric potential Vp as the amount of current flowing into the power supply line is increased.

The amount of current flowing into a power supply line is varied depending on an image to be displayed. This is because the ratio of pixels that emit light and the ratio of pixels that do not emit light to all the pixels, that share the same power supply line, vary between images. When an image to be displayed requires more pixels that emit light than pixels that do not emit light, the amount of current flowing into the power supply line is larger and the difference in electric potential among different sites of the power supply line is greater. On the other hand, when an image to be displayed requires more pixels that do not emit light than pixels that emit light, the amount of current flowing into the power supply line is smaller as well as the difference in electric potential among different sites of the power supply line.

The difference in electric potential given to source regions makes an electric potential given through one EL driving TFT 9004 to the pixel electrode of one EL element 9006 different from an electric potential given through another EL driving TFT 9004 to the pixel electrode of another EL element 9006. The amount of current flowing into an EL element is different from the amount of current flowing into another EL element whose pixel electrode is connected through the EL driving TFT 9004 to the power supply line to which the former EL element is connected. Therefore EL elements connected to the same power supply line emit light with different luminance in accordance with positions at which the EL elements are connected to the power supply line. The term luminance herein means brightness of an EL element per unit area at the instant the EL element emits light.

The difference in luminance among pixels is greater when the difference in electrics potential over the length of a power supply line is greater.

FIGS. 18A and 18B are schematic diagrams of gray scale of pixels in a pixel portion. In FIGS. 18A and 18B, the pixel portion has nine pixels for the sake of simple explanation.

A pixel (1, 1), a pixel (1, 2), and a pixel (1, 3) have the same power supply line V1. In other words, pixel electrodes of EL elements of the pixel (1, 1), the pixel (1, 2), and the pixel (1, 3) are connected to the same power supply line V1 through EL driving A pixel (2, 1), a pixel (2, 2), and a pixel (2, 3) have the same power supply line V2. A pixel (3, 1), a pixel (3, 2), and a pixel (3, 3) have the same power supply line V3.

Source regions of EL driving TFTs of the pixel (1, 1), the pixel (2, 1), and the pixel (3, 1) are respectively connected to the power supply lines V1, V2, and V3 on the closest side to the power supply.

Consider a case where all the pixels are to emit light with the same intermediate gray scale. The same amount of current flows into the power supply lines V1, V2, and V3. Due to the wiring line resistance, the electric potential of a power supply lines becomes closer to the electric potential of a ground as the distance from the power supply is increased. Accordingly, the pixel (1, 1), the pixel (2, 1), and the pixel (3, 1) are the brightest whereas the pixel (1, 3), the pixel (2, 3), and the pixel (3, 3) are the darkest.

In this case, however, the difference in luminance between adjacent pixels is not great enough to be recognizable by the human eye. Also, although the difference in luminance is the greatest between the nearest pixel to the power supply of a power supply line and the farthest pixel from the power supply, the human eye hardly detects the difference in luminance between pixels apart from each other.

Next, consider a case where all pixels except the pixel (2, 2) art to emit light with the same intermediate gray scale. The current flowing into the power supply line V2 is smaller than the current respectively flowing into the power supply lines V1 and V3. Therefore, the difference in electric potential over the length of the power supply line V2 is smaller than those of the power supply lines V1 and V3.

As the difference in electric potential over the length of a power supply line becomes smaller, the electric potential of the power supply line becomes closer to the power supply electric potential Vp than the electric potential of a ground. Then, the difference in electric potential between a pixel electrode of an EL element and an opposite electrode of the EL element is increased to increase the amount of current flowing into the EL element and raise the luminance of pixels that have this power supply line.

Accordingly, the luminance of the pixel (2, 1) is higher than the luminance of the pixel (1, 1) and the pixel (3, 1) as shown in FIG. 18A. The luminance of the pixel (2, 3) is higher than the luminance of the pixel (1, 3) and the pixel (3, 3).

The human eye has difficulty in detecting the difference in luminance between pixels apart from each other. Therefore, the difference in luminance between the pixel (1, 1) or the pixel (3, 1) and the pixel (1, 3) or the pixel (3, 3) is not so obvious to the human eye. However, a large difference in luminance between adjacent pixels is noticeable and easily recognized by the human eye. The difference in luminance between the pixel (2, 1) and the pixel (1, 1), or the pixel (2, 1) and the pixel (3, 1), is obvious to the human eye, as well as the difference in luminance between the pixel (2, 3) and the pixel (1, 3), or the pixel (2, 3) and the pixel (3, 3).

Another case is considered in which the pixel (2, 2) emits light with the highest luminance while the rest of the pixels all emit light with intermediate gray scale. In this case, the amount of current flowing into the power supply line V2 is larger than the amount of current respectively flowing into the power supply lines V1 and V3. The difference in electric potential over the length of the power supply line V2 is accordingly greater than those of the power supply lines V1 and V3.

As the difference in electric potential over the length of a power supply line becomes greater, the electric potential of the power supply line becomes closer to the electric potential of a ground than the power supply electric potential Vp. Then, the difference in electric potential between a pixel electrode of an EL element and an opposite electrode of the EL element is decreased to reduce the amount of current flowing into the EL element and lower the luminance of pixels that have this power supply line.

Accordingly, the luminance of the pixel (2, 1) is lower than the luminance of the pixel (1, 1) and the pixel (3, 1) as shown in FIG. 18B. The luminance of the pixel (2, 3) is lower than the luminance of the pixel (1, 3) and the pixel (3, 3).

Similar to the case illustrated in FIG. 18A, the human eye has difficulty in detecting the difference in luminance between pixels apart from each other. Therefore, the difference in luminance between the pixel (1, 1) or the pixel (3, 1) and the pixel (1, 3) or the pixel (3, 3) is not so obvious to the human eye. However, a large difference in luminance between adjacent pixels is noticeable and easily recognized by the human eye. The difference in luminance between the pixel (2, 1) and the pixel (1, 1) or the pixel (2, 1) and the pixel (3, 1) is obvious to the human eye, as well as the difference in luminance between the pixel (2, 3) and the pixel (1, 3) or the pixel (2, 3) and the pixel (3, 3).

The phenomena shown in FIGS. 18A and 18B is called crosstalk. Crosstalk takes place more often as the area of the pixel portion is increased and the wiring line resistance of the power supply lines is raised.

SUMMARY OF THE INVENTION

The present invention has been made in view of the above and an object of the present invention is therefore to provide a light emitting device which is capable of preventing crosstalk from taking place.

The present inventor thought it important to prevent the difference in electric potential over the length of a power supply line from varying depending on an image to be displayed, in order to avoid crosstalk. Therefore, a TFT for controlling the amount of current flowing through a power supply line when an EL element does not emit light (electric discharge TFT) is provided in each pixel.

The electric discharge TFT has a source region and a drain region, one of which is connected to a power supply line and the other of which has a predetermined electric potential (reference electric potential) given. When an electric potential of an opposite electrode (opposite electric potential) is higher than the electric potential of the power supply line (power supply electric potential), the reference electric potential is set higher than the power supply electric potential. On the other hand, when the electric potential of the opposite electrode (opposite electric potential) is lower than the electric potential of the power supply line (power supply electric potential), the reference electric potential is set lower than the power supply electric potential.

In this specification, "connection" refers to electrical connection.

Light emission of an EL element is controlled by an EL driving TFT in the present invention. A digital video signal is used to control switching of the EL driving TFT. When the EL driving TFT is turned ON, the EL element emits light and the electric discharge TFT is turned OFF.

On the other hand, when the EL driving TFT is turned OFF, the EL element does not emit light. The electric discharge TFT at this point is turned ON and a current flows into a channel formation region of the electric discharge TFT.

The current flowing into the channel formation region of the electric discharge TFT runs from a drain region to a source region when the electric discharge TFT is an n-channel TFT. When the electric discharge TFTs a p-channel TFT, on the other hand, the current runs from the source region to the drain region.

The amount of current flowing into the channel formation region of the electric discharge TFT is preferably the same as the amount of current flowing through an EL element during emitting light. However, the present invention is not limited thereto. It is sufficient if a current flows into the channel formation region of the electric discharge TFT in a large amount enough to prevent crosstalk from taking place.

The above structure can prevent the difference in electric potential over the length of a power supply line from varying depending on an image to be displayed. Accordingly, the same amount of current flows into EL elements emitting light in adjacent pixels whatever image is to be displayed, thereby avoiding crosstalk.

According to the present invention, the difference in electric potential over the length of a power supply line is independent of images to be displayed. Therefore, the level of electric potential of a pixel electrode of an EL element can be deduced solely by the position of the pixel. Then, based on the level of electric potential of the pixel electrode which is calculated from the position of the pixel, a digital video signal is corrected and a period during which the EL element emits light is adjusted. In this way, difference in luminance between EL elements due to positions of their pixels is canceled and the pixels can provide the same gray scale.

The structure of the present invention will be shown below.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

a current flows through channel formation regions of the plural electric discharge TFTs when the plural EL elements do not emit light; and the plural electric discharge TFTs are turned OFF while the plural EL elements emit light.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

a current flows through channel formation regions of the plural EL driving TFTs while the plural EL elements emit light;

a current flows through channel formation regions of the plural electric discharge TFTs when the plural EL elements do not emit light; and the plural electric discharge TFTs are turned OFF while the plural EL elements emit light.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

a current flows through channel formation regions of the plural EL driving TFTs and the plural electric discharge TFTs are turned OFF while the plural EL elements emit light;

a current flows through channel formation regions of the plural electric discharge TFTs when the plural EL elements do not emit light; and the current flowing through the channel formation regions of the plural electric discharge TFTs runs from the drain regions to the source regions when the current flowing through the channel formation regions of the plural EL driving TFTs runs from the source regions to the drain regions, and the current flowing through the channel formation regions of the plural electric discharge TFTs runs from the source regions to the drain regions when the current flowing through the channel formation regions of the plural EL driving TFTs runs from the drain regions to the source regions.

The present invention provides a light emitting device characterized in that: source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

a current flows through channel formation regions of the plural EL driving TFTs and the plural electric discharge TFTs are turned OFF while the plural EL elements emit light;

a current flows through channel formation regions of the plural electric discharge TFTs when the plural EL elements do not emit light;

the current flowing through the channel formation regions of the plural electric discharge TFTs runs from the drain regions to the source regions when the current flowing through the channel formation regions of the plural EL driving TFTs runs from the source regions to the drain regions, and the current flowing through the channel formation regions of the plural electric discharge TFTs runs from the source regions to the drain regions when the current flowing through the channel formation regions of the plural EL driving TFTs runs from the drain regions to the source regions; and the amount of current flowing through the channel formation regions of the plural EL driving TFTs is the same as the amount of current flowing through the channel formation regions of the plural electric discharge TFTs.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

gate electrodes of the plural EL driving TFTs are respectively connected to gate electrodes of the plural electric discharge TFTs;

a current flows through channel formation regions of the plural electric discharge TFTs when the plural EL elements do not emit light; and the plural electric discharge TFTs are turned OFF while the plural EL elements emit light.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

gate electrodes of the plural EL driving TFTs are respectively connected to gate electrodes of the plural electric discharge TFTs;

the polarity of the plural EL driving TFTs is different from the polarity of the plural electric discharge TFTs;

a current flows through channel formation regions of the plural electric discharge TFTs when the plural EL elements do not emit light; and the plural electric discharge TFTs are turned OFF while the plural EL elements emit light.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

gate electrodes of the plural EL driving TFTs are respectively connected to gate electrodes of the plural electric discharge TFTs;

a current flows through channel formation regions of the plural EL driving TFTs and the plural electric discharge TFTs are turned OFF while the plural EL elements emit light; and a current flows through channel formation regions of the plural electric discharge TFTs when the plural EL elements do not emit light.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential; gate electrodes of the plural EL driving TFTs are respectively connected to gate electrodes of the plural electric discharge TFTs;

a current flows through channel formation regions of the plural EL driving TFTs and the plural electric discharge TFTs are turned OFF while the plural EL elements emit light;

a current flows through channel formation regions of the plural electric discharge TFTs when the plural EL elements do not emit light; and the current flowing through the channel formation regions of the plural electric discharge TFTs runs from the drain regions to the source regions when the current flowing through the channel formation regions of the plural EL driving TFTs runs from the source regions to the drain regions, and the current flowing through the channel formation regions of the plural electric discharge TFTs runs from the source regions to the drain regions when the current flowing through the channel formation regions of the plural EL driving TFTs runs from the drain regions to the source regions.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

gate electrodes of the plural EL driving TFTs are respectively connected to gate electrodes of the plural electric discharge TFTs;

a current flows through channel formation regions of the plural EL driving TFTs and the plural electric discharge TFTs are turned OFF while the plural EL elements emit light;

a current flows through channel formation regions of the plural electric discharge TFTs when the plural EL elements do not emit light;

the current flowing through the channel formation regions of the plural electric discharge TFTs runs from the drain regions to the source regions when the current flowing through the channel formation regions of the plural EL driving TFTs runs from the source regions to the drain regions, and the current flowing through the channel formation regions of the plural electric discharge TFTs runs from the source regions to the drain regions when the current flowing through the channel formation regions of the plural EL driving TFTs runs from the drain regions to the source regions; and the amount of current flowing through the channel formation regions of the plural EL driving TFTs is the same as the amount of current flowing through the channel formation regions of the plural electric discharge TFTs.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

gate electrodes of the plural EL driving TFTs are respectively connected to gate electrodes of the plural electric discharge TFTs;

the polarity of the plural EL driving TFTs is different from the polarity of the plural electric discharge TFTs;

a current flows through channel formation regions of the plural EL driving TFTs and the plural electric discharge TFTs are turned OFF while the plural EL elements emit light; and a current flows through channel formation regions of the plural electric discharge TFTs when the plural EL elements do not emit light.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

gate electrodes of the plural EL driving TFTs are respectively connected to gate electrodes of the plural electric discharge TFTs;

the polarity of the plural EL driving TFTs is different from the polarity of the plural electric discharge TFTs;

a current flows through channel formation regions of the plural EL driving TFTs and the plural electric discharge TFTs are turned OFF while the plural EL elements emit light;

a current flows through channel formation regions of the plural electric discharge TFTs when the plural EL elements do not emit light; and the current flowing through the channel formation regions of the plural electric discharge TFTs runs from the drain regions to the source regions when the current flowing through the channel formation regions of the plural EL driving TFTs runs from the source regions to the drain regions, and the current flowing through the channel formation regions of the plural electric discharge TFTs runs from the source regions to the drain regions when the current flowing through the channel formation regions of the plural EL driving TFTs runs from the drain regions to the source regions.

The present invention provides a light emitting device characterized in that:

source regions of a plurality of EL driving TFTs and drain regions of a plurality of electric discharge TFTs are connected to one power supply line;

pixel electrodes of a plurality of EL elements are respectively connected to drain regions of the plural EL driving TFTs;

source regions of the plural electric discharge TFTs receive a given electric potential;

gate electrodes of the plural EL driving TFTs are respectively connected to gate electrodes of the plural electric discharge TFTs;

the polarity of the plural EL driving TFTs is different from the polarity of the plural electric discharge TFTs;

a current flows through channel formation regions of the plural EL driving TFTs and the plural electric discharge TFTs are turned OFF while the plural EL elements emit light;

a current flows through channel formation regions of the plural electric discharge TFTs when the plural EL elements do not emit light; and the current flowing through the channel formation regions of the plural electric discharge TFTs runs from the drain regions to the source regions when the current flowing through the channel formation regions of the plural EL driving TFTs runs from the source regions to the drain regions, and the current flowing through the channel formation regions of the plural electric discharge TFTs runs from the source regions to the drain regions when the current flowing through the channel formation regions of the plural EL driving TFTs runs from the drain regions to the source regions; and the amount of current flowing through the channel formation regions of the plural EL driving TFTs is the same as the amount of current flowing through the channel formation regions of the plural electric discharge TFTs.

The present invention may be characterized in that switching of the plural EL driving TFTs and the plural electric discharge TFTs is controlled by digital video signals inputted to the gate electrodes of the plural EL driving TFTs and the gate electrodes of the plural electric discharge TFTs.

The present invention may be characterized in that the digital video signals are inputted to the gate electrodes of the plural EL driving TFTs and the gate electrodes of the plural electric discharge TFTs through their respective switching TFTs.

The present invention may be characterized in that one of the source regions and the drain regions of the plural electric discharge TFTs that are not connected to the power supply lines are connected to gate electrodes of the plural switching TFTs on one on one basis.

The present invention may be characterized in that one of the source regions and the drain regions of the plural electric discharge TFTs that are not connected to the power supply lines are connected to gate electrodes of the plural switching TFTs on one on one basis, and that the digital video signals are respectively inputted to the gate electrodes of the associated plural electric discharge TFTs through the plural switching TFTs.

The present invention may be characterized in that the plural switching TFTs and the plural electric discharge TFTs have the same polarity.

The present invention may be characterized in that one of the source regions and the drain regions of the plural electric discharge TFTs that are not connected to the power supply lines are connected to opposite electrodes of the plural EL elements.

The present invention may be characterized in that one of the source regions and the drain regions of the plural electric discharge TFTs that are not connected to the power supply lines are respectively connected to gate electrodes of the plural switching TFTs through first current controlling elements.

The present invention may be characterized in that the plural switching TFTs and the plural electric discharge TFTs have the same polarity.

The present invention may be characterized in that one of the source regions and the drain regions of the plural electric discharge TFTs that are not connected to the power supply lines are respectively connected to opposite electrodes of the plural EL elements through first current controlling elements.

The present invention may be characterized in that the source regions of the plural electric discharge TFTs are connected to first current controlling elements, and that the source regions of the plural electric discharge TFTs receive a given electric potential through the first current controlling elements.

The present invention may be characterized in that the first current controlling elements are resistors, diodes, or TFTs.

The present invention may be characterized in that the drain regions of the plural electric discharge TFTs are connected to the power supply lines through second current controlling elements.

The present invention may be characterized in that the second current controlling elements are resistors, diodes, or TFTs.

The present invention may be characterized in that positions at which the power supply lines are connected to the source regions or the drain regions of the plural EL driving TFTs are used to adjust light emission periods of the plural EL elements respectively connected to one of the source regions and the drain regions of the plural EL driving TFTs that are not connected to the power supply lines.

The present invention provides an electronic device that employ the light emitting device.

DETAILED DESCRIPTION OF THE PREFERRED EMBODIMENTS

[Embodiment Mode 1]

Figure 1:
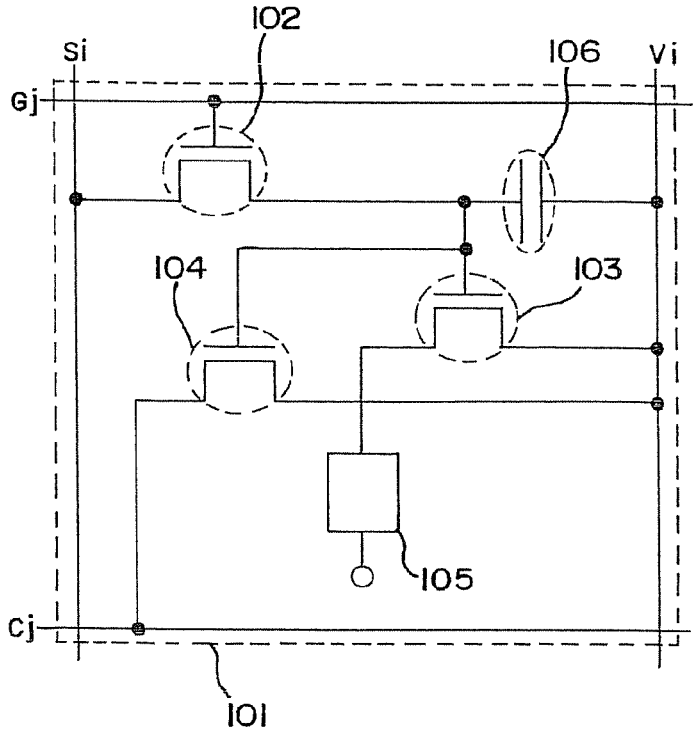
FIG. 1 is a circuit diagram of a pixel in a light emitting device of the present invention.

FIG. 1 shows the structure of a pixel in alight emitting device of the present invention. A plurality of pixels 101 are provided in a pixel portion of the light emitting device of the present invention. Each of the pixels 101 has a source signal line Si (one of source signal lines S1 to Sx), a power supply line Vi (one of power supply lines V1 to Vx), a gate signal line Gj (one of gate signal lines G1 to Gy), and a reference power supply line Cj (one of power supply lines G1 to Cy). Each of the pixels 101 also has a switching TFT 102, an EL driving TFT 103, an electric discharge TFT 104, an EL element 105, and a capacitor 106.

The polarity of the EL driving TFT 103 is reverse to the polarity of the electric discharge TFT 104. Accordingly, the electric discharge TFT 104 is a p-channel when the EL driving TFT 103 is an n-channel TFT. On the other hand, the electric discharge TFT 104 is an n-channel TFT when the EL driving TFT 103 is a p-channel TFT.

A gate electrode of the switching TFT 102 is connected to the gate signal line Gj. The switching TFT 102 has a source region and a drain region, one of which is connected to the source signal line Si and the other of which is connected to a gate electrode of the EL driving TFT 103 and to a gate electrode of the electric discharge TFT 104.

The capacitor 106 is placed between the gate electrodes of the EL driving TFT 103 and of the electric discharge TFT 104 and the power supply line Vi. The capacitor 106 is provided to hold the electric potential of the gate electrodes of the EL driving TFT 103 and of the electric discharge TFT 104 when the switching TFT 102 is not selected (OFF state).

The EL driving TFT 103 has a source region connected to the power supply line Vi, and has a drain region connected to a pixel electrode of the EL element 105.

The electric discharge TFT 104 has a source region and a drain region, one of which is connected to the power supply line Vi and the other of which is connected to the reference power supply line Cj.

The EL element 105 is composed of an anode, a cathode, and an EL layer that is interposed between the anode and the cathode. When the anode is connected to the drain region of the EL driving TFT 103, the anode serves as the pixel electrode whereas the cathode serves as an opposite electrode. When the cathode is connected to the drain region of the EL driving TFT 103, on the other hand, the cathode serves as the pixel electrode whereas the anode serves as the opposite electrode.

The opposite electrode of the EL element 105 receives an electric potential (opposite electric potential) from a power supply which is provided outside the EL panel. The power supply line Vi also receives an electric potential (power supply electric potential) from a power supply which is provided outside the EL panel. Further, the reference power supply line Cj receives an electric potential (reference electric potential) from a power supply which is provided to the EL panel.

The operation of the pixels 101 shown in FIG. 1 will be described next. In driving the light emitting device according to the present invention, a plurality of sub-frame periods are provided in one frame period. The operation of each pixel in one sub-frame period is described while distinguishing the operation in a writing period from the operation in a display period.

First, in a writing period, the power supply electric potential of the power supply line Vi is kept at the same level as the opposite electric potential of the opposite electrode. Strictly speaking, the electric potential difference between the power supply electric potential of the power supply line Vi and the opposite electric potential of the opposite electrode is set to a level that does not allow the EL element 105 to emit light when the power supply electric potential is given to the pixel electrode. Also, the power supply electric potential of the power supply line Vi is kept at the same level as the reference electric potential of the reference power supply line Cj in the writing period.

The gate signal lines G1 to Gy are sequentially selected until all of them in the pixel portion are selected once. While the respective gate signal lines are selected, digital video signals associated with the respective pixels are inputted to the source signal lines S1 to Sx. More detailed description will be given on the operation of the pixels in the writing period taking as an example the pixel that has the source signal line Si and the gate signal line Gj.

The gate signal line Gj is selected by input of a selection signal to the gate signal line Gj. Then, every switching TFT 102 which have a gate electrode connected to the gate signal line Gj is turned ON.

Digital a video signal equivalent to 1 bit is inputted to the source signal line Si, and then inputted, through the switching TFT 102 that has been turned ON, to the gate electrodes of the EL driving TFT 103 and of the electric discharge TFT 104.

The digital video signal equivalent to 1 bit have information of '1' or '0'. With the information of '1' or '0' carried by the digital video signal equivalent to 1 bit, switching of the EL driving TFT 103 and the electric discharge TFT 104 is controlled. Since the polarity of the EL driving TFT 103 is reverse to the polarity of the electric discharge TFT 104, the electric discharge TFT 104 is turned OFF when the EL driving TFT 103 is turned ON, whereas the electric discharge TFT 104 is turned ON when the EL driving TFT 103 is turned OFF.

The writing period is finished as the digital video signals equivalent to 1 bit are inputted to all of the pixels. In this specification, digital "video signals being inputted to a pixel" means that the digital video signals are inputted to gate electrodes of the EL driving TFT and of the electric discharge TFT in that pixel.

After the writing period is finished, a display period is started. In the display period, the electric potential difference between the power supply electric potential of the power supply line Vi and the opposite electric potential of the opposite electrode is set to a level that allows the EL element 105 to emit light when the power supply electric potential is given to the pixel electrode. Also, there is a difference between the power supply electric potential of the power supply line Vi and the reference electric potential of the reference power supply line Cj in the display period.

If the digital video signals equivalent to 1 bit, which have been inputted during the writing period, turn the EL driving TFT 103 ON and the electric discharge TFT 104 OFF, the power supply electric potential of the power supply line Vi is given to the pixel electrode of the EL element 105 through the EL driving TFT that is turned ON. As a result, the EL element 105 emits light.

On the other hand, if the digital video signals equivalent to 1 bit, which have been inputted during the writing period, turn the EL driving TFT 103 OFF and the electric discharge TFT 104 ON, the power supply electric potential of the power supply line Vi is not given to the pixel electrode of the EL element 105. As a result, the EL element 105 does not emit light. Then, due to the electric potential difference between the power supply electric potential of the power supply line Vi and the reference electric potential of the reference power supply line Cj, a current flows between the power supply line Vi and the reference power supply line Cj through the electric discharge TFT 104. This current flows in the same direction as a current that flows in the power supply line Vi while the EL element emits light.

Preferably, the amount of current flowing into a channel formation region of the electric discharge TFT 104 when the electric discharge TFT 104 is ON, is the same as the amount of current flowing into a channel formation region of the EL driving TFT 103 when the EL element 105 emits light. To achieve this, it is necessary to adjust electric potential difference between the power supply electric potential of the power supply line Vi and the reference electric potential of the reference power supply line Cj.

As the display period is finished, a writing period of the next sub-frame period is started to conduct the above operation again. However, digital video signals inputted to pixels in the writing period of the next sub-frame period are of the next bit.

When all of the sub-frame periods are finished, one frame period is completed.

Figure 2:
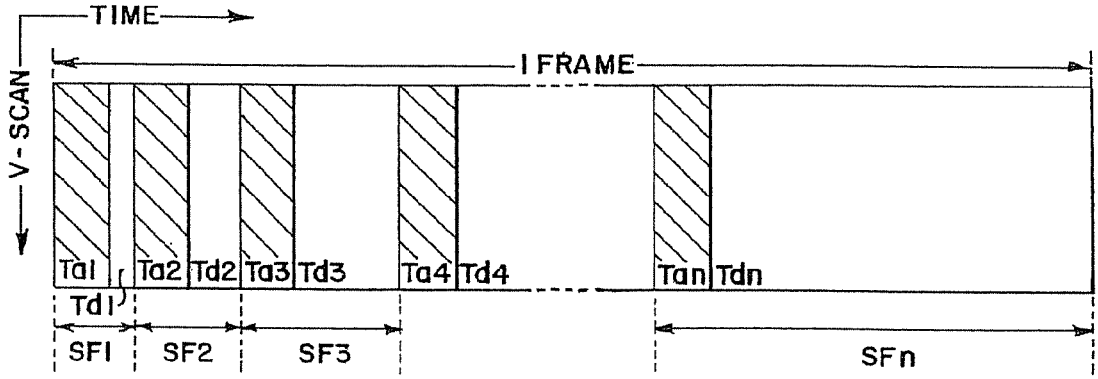
FIG. 2 is a diagram showing a method of driving a light emitting device according to the present invention.

FIG. 2 shows points at which n sub-frame periods turn up in one frame period. The axis of abscissa indicates time whereas the axis of ordinate indicates the position of a gate signal line of a pixel.

Each of the n sub-frame periods has a writing period and a display period. Accordingly, one frame period has at least n writing periods (Ta1 to Tan) and n display periods (Td1 to Tdn).

The n writing periods (Ta1 to Tan) and the n display periods (Td1 to Tdn) are associated with the respective bits of n bit digital video signals. When an image is to be displayed using n bit digital video signals, at least n writing periods and n display periods are provided in one frame period.

Writing periods Ta and display periods Td are repeated during one frame period. When one frame period is completed, one image is displayed.

Lengths of the display periods Td1 to Tdn are set to satisfy Td1:Td2: . . . :Tdn=$2^0$:$2^1$: . . . :$2^{n-1}$. The gray scale of each pixel is obtained by the sum of lengths of display periods in one frame period during which that pixel emits light. Accordingly, a desired gray scale is obtained by controlling the sum of lengths of display periods in one frame period during which a pixel emits light.

The sub-frame periods may not turn up in the order shown in FIG. 2. There is no rule about the order in which sub-frame periods SF1 to SFn are to come up and any order can be chosen.

Although described in this embodiment is the case in which no EL elements emit light during any writing period, the present invention is not limited thereto. The EL elements may emit light to display an image during a writing period.

In this case, in the writing period, the electric potential difference between the power supply electric potential of the power supply line Vi and the opposite electric potential of the opposite electrode is set to a level that allows the EL element 105 to emit light when the power supply electric potential is given to the pixel electrode. Lengths of the display periods Td1 to Tdn may not satisfy Td1:Td2: . . . :Tdn=$2^0$:$2^1$: . . . :$2^{n-1}$ but instead lengths of the sub-frame periods SF1 to SFn are set to meet SF1:SF2: . . . :SFn=$2^0$:$2^1$: . . . :$2^{n-1}$.

In this embodiment mode, the power supply electric potential of the power supply line Vi is kept at the same level as the reference electric potential of the reference power supply line Cj in a writing period. However, the present invention is not limited thereto. Similar to a display period, a writing period may be set with an electric potential difference between the power supply electric potential of the power supply line Vi and the reference electric potential of the reference power supply line Cj.

According to the present invention, a current flows between a power supply line and a reference power supply line through an electric discharge TFT even in a pixel whose an EL element is not emitting light. Therefore, variation of the difference in electric potential over the length of a power supply line depending on an image to be displayed is contained. Thus reduced is the difference in amount of current flowing into EL elements in adjacent pixels while the EL elements emit light. The difference in luminance between the adjacent pixels are accordingly reduced and crosstalk can be avoided.

[Embodiment Mode 2]

Described in this embodiment mode is about, in the pixel of the light emitting device shown in FIG. 1, providing a current controlling element between the source region or the drain region of the electric discharge TFT and the power supply line Vi, and also providing a current controlling element between the source region or the drain region Of the electric discharge TFT and the reference power supply line Cj.

Figure 3:
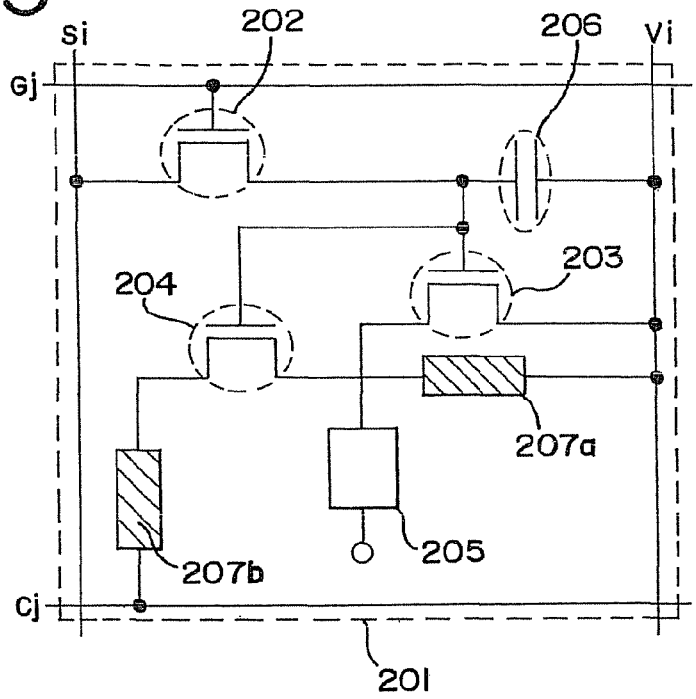
FIG. 3 is a circuit diagram of a pixel in a light emitting device of the present invention.

FIG. 3 shows the structure of a pixel according to this embodiment mode. A pixel 201 has a source signal line Si (one of source signal lines S1 to Sx), a power supply line Vi (one of power supply lines V1 to Vx), a gate signal line Gj (one of gate signal lines G1 to Gy), and a reference power supply line Cj (one of power supply lines G1 to Cy). The pixel 201 also has a switching TFT 202, an EL driving TFT 203, an electric discharge TFT 204, an EL element 205, a capacitor 206, and current controlling elements 207*a* and 207*b*.

As in the case of FIG. 1, the polarity of the EL driving TFT 203 is reverse to the polarity of the electric discharge TFT 204. Accordingly, the electric discharge TFT 204 is a p-channel TFT when the EL driving TFT 203 is an n-channel TFT. On the other hand, the electric discharge TFT 204 is an n-channel TFT when the EL driving TFT 203 is a p-channel TFT.

A gate electrode of the switching TFT 202 is connected to the gate signal line Gj. The switching TFT 202 has a source region and a drain region, one of which is connected to the source signal line Si and the other of which is connected to a gate electrode of the EL driving TFT 203 and to a gate electrode of the electric discharge TFT 204.

The capacitor 206 is placed between the gate electrodes of the EL driving TFT 203 and of the electric discharge TFT 204 and the power supply line Vi. The capacitor 206 is provided to hold the electric potential of the gate electrodes of the EL driving TFT 203 and of the electric discharge TFT 204 when the switching TFT 202 is not selected (OFF state).

The EL driving TFT 203 has a source region connected to the power supply line Vi, and has a drain region connected to a pixel electrode of the EL element 205.

In this embodiment mode, the electric discharge TFT 204 has a source region and a drain region, one of which is connected to the power supply line Vi through the current controlling element 207*a* and the other of which is connected to the reference power supply line Cj through the current controlling element 207*b*.

The EL element 205 is composed of an anode, a cathode, and an EL layer that is interposed between the anode and the cathode. When the anode is connected to the drain region of the EL driving TFT 203, the anode serves as the pixel electrode whereas the cathode serves as an opposite electrode. When the cathode is connected to the drain region of the EL driving TFT 203, on the other hand, the cathode serves as the pixel electrode whereas the anode serves as the opposite electrode.

The opposite electrode of the EL element 205 receives an electric potential (opposite electric potential) from a power supply which is provided outside the EL panel. The power supply line Vi also receives an electric potential (power supply electric potential) from a power supply which is provided outside the EL panel. Further, the reference power supply line Cj receives an electric potential (reference electric potential) from a power supply which is provided outside the EL panel.

A description on details about the operation of the pixel 201 is omitted here since it is the same as Embodiment Mode 1.

The current controlling elements 207*a* and 207*b* are elements that can control the amount of current flowing into a channel formation region of the electric discharge TFT 204. With the current controlling elements 207*a* and 207*b*, the amount of current flowing into the channel formation region of the electric discharge TFT 204 approaches to the amount of current flowing into a channel formation region of the EL driving TFT 203 when the EL element 205 emits light, even if the power supply electric potential of the power supply line Vi and the reference electric potential of the reference power supply line Cj are fixed while the electric discharge TFT 204 is ON.

Although a current controlling element is provided at each side of the electric discharge TFT 204, namely, the source region side and the drain region side, the present invention is not limited thereto. The current controlling element may be provided only at the source region side of the electric discharge TFT 204 or only at the drain region side thereof. Alternatively, two or more current controlling elements may be provided at the source region side of the electric discharge TFT 204 or two or more at the drain region side thereof.

However, it is preferred for the source region of the electric discharge TFT 204 to be connected directly to the wiring line without interposing any current controlling element because the direct connection makes it easy to control the amount of current flowing into the channel formation region of the electric discharge TFT 204.

According to the present invention, a current flows between a power supply line and a reference power supply line through an electric discharge TFT even in a pixel whose EL element is not emitting light. Therefore, variation of the difference in electric potential over the length of a power supply line depending on an image to be displayed is contained. Thus reduced is the difference in amount of current flowing into EL elements in adjacent pixels while the EL elements emit light. The difference in luminance between the adjacent pixels are accordingly reduced and crosstalk can be avoided.

[Embodiment Mode 3]

This embodiment mode describes the structure of the pixel in the light emitting device shown in FIG. 1 when the gate signal line Gj substitutes for the reference power supply line Cj.

Figure 4:
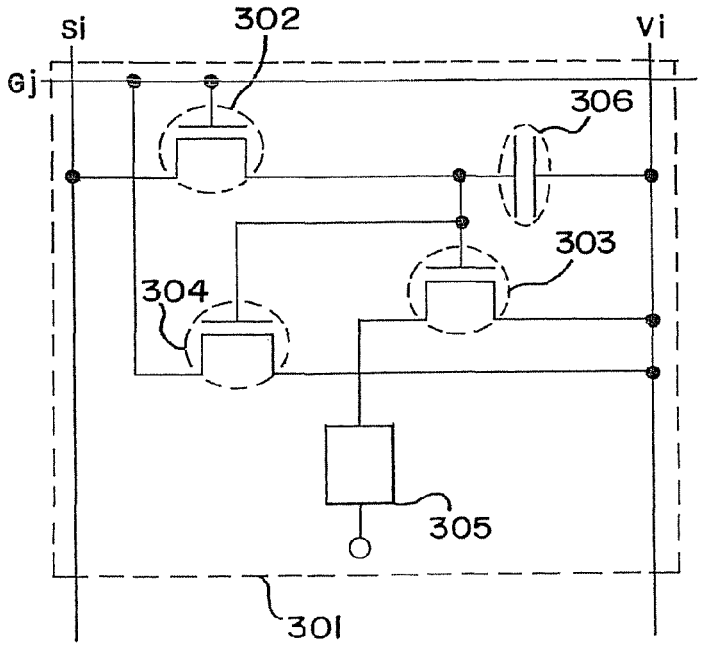
FIG. 4 is a circuit diagram of a pixel in a light emitting device of the present invention.

FIG. 4 shows the structure of a pixel according to this embodiment mode. A pixel 301 has a source signal line Si (one of source signal lines S1 to Sx), a power supply line Vi (one of power supply lines V1 to Vx), and a gate signal line Gj (one of gate signal lines G1 to Gy). The pixel 301 also has a switching TFT 302, an EL driving TFT 303, an electric discharge TFT 304, an EL element 305, and a capacitor 306.

A gate electrode of the switching TFT 302 is connected to the gate signal line Gj. The switching TFT 302 has a source region and a drain region, one of which is connected to the source signal line Si and the other of which is connected to a gate electrode of the EL driving TFT 303 and to a gate electrode of the electric discharge TFT 304.

The capacitor 306 is placed between the gate electrodes of the EL driving TFT 303 and of the electric discharge TFT 304 and the power supply line Vi. The capacitor 306 is provided to hold the electric potential of the gate electrodes of the EL driving TFT 303 and of the electric discharge TFT 304 when the switching TFT 302 is not selected (OFF state).

The EL driving TFT 303 has a source region connected to the power supply line Vi, and has a drain region connected to a pixel electrode of the EL element 305.

In this embodiment mode, the electric discharge TFT 304 has a source region and a drain region, one of which is connected to the power supply line Vi and the other of which is connected to the gate signal line Gj.

When the source region or the drain region of the electric discharge TFT 304 is connected to the gate signal line, the electric potential of the gate signal line when it is not selected has to be set lower than the power supply electric potential if the EL driving TFT 303 is a p-channel TFT. On the other hand, if the EL driving TFT 303 is an n-channel TFT, the electric potential of the gate signal line when it is not selected has to be set higher than the power supply electric potential. Accordingly, the switching TFT 302 and the electric discharge TFT 304 in this embodiment mode have the same polarity. The polarity of the switching TFT 302 and of the electric discharge TFT 304 is reverse to the polarity of the EL driving TFT 303. Therefore, the switching TFT 302 and the electric discharge TFT are p-channel TFTs when the EL driving TFT is an n-channel TFT, whereas the switching TFT 302 and the electric discharge TFT are n-channel TFTs when the EL driving TFT is a p-channel TFT.

The EL element 305 is composed of an anode, a cathode, and an EL layer that is interposed between the anode and the cathode. When the anode is connected to the drain region of the EL driving TFT 303, the anode serves as the pixel electrode whereas the cathode serves as an opposite electrode. When the cathode is connected to the drain region of the EL driving TFT 303, on the other hand, the cathode serves as the pixel electrode whereas the anode serves as the opposite electrode.

The opposite electrode of the EL element 305 receives an electric potential (opposite electric potential) from a power supply which is provided outside the EL panel. The power supply line Vi also receives an electric potential (power supply electric potential) from a power supply which is provided outside the EL panel.

The operation of the pixel 301 shown in FIG. 4 will be described next. Similar to Embodiment Mode 1, a plurality of sub-frame periods are provided in one frame period in this embodiment mode. The operation of each pixel in one sub-frame period is described while distinguishing the operation in a writing period from the operation in a display period.

First, in a writing period, the power supply electric potential of the power supply line Vi is kept at the same level as the opposite electric potential of the opposite electrode. Strictly speaking, the electric potential difference between the power supply electric potential of the power supply line Vi and the opposite electric potential of the opposite electrode is set to a level that does not allow the EL element 305 to emit light when the power supply electric potential is given to the pixel electrode.

In this embodiment mode, the electric potential difference between power supply electric potential of the power supply line Vi and the electric potential of the gate signal line not selected is larger than the electric potential difference between power supply electric potential of the power supply line Vi and the electric potential of the gate signal line Gj selected. The power supply electric potential of the power supply line Vi is kept constant in this embodiment mode.

The gate signal lines G1 to Gy are sequentially selected by input of selection signals until all of them in a pixel portion are selected once. While the respective gate signal lines are selected, digital video signals associated with the respective pixels are inputted to the source signal lines S1 to Sx. More detailed description will be given on the operation of the pixels in the writing period taking as an example the pixel that has the source signal line Si and the gate signal line Gj.

The gate signal line Gj is selected by input of a selection signal to the gate signal line Gj. Then, every switching TFT 302 which has a gate electrode connected to the gate signal line Gj is turned ON.

A digital video signal equivalent to 1 bit is inputted to the source signal line Si and then inputted through the switching TFT 302 that has been turned ON to the gate electrodes of the EL driving TFT 303 and of the electric discharge TFT 304.

The digital video signal equivalent to 1 bit has information of '1' or '0'. With the information of '1' or '0' carried by the digital video signal equivalent to 1 bit, switching of the EL driving TFT 303 and the electric discharge TFT 304 is controlled. Since the polarity of the EL driving TFT 303 is reverse to the polarity of the electric discharge TFT 304, the electric discharge TFT 304 is turned OFF when the EL driving TFT 303 is turned ON whereas the electric discharge TFT 304 is turned ON when the EL driving TFT 303 is turned OFF.

The writing period is finished as the digital video signals equivalent to 1 bit are inputted to all of the pixels.

After the writing period is finished, a display period is started. In the display period, the level of the opposite electric potential of the opposite electrode is changed so that the electric potential difference between the power supply electric potential of the power supply line Vi and the opposite electric potential of the opposite electrode is set to a level that allows the EL element 305 to emit light when the power supply electric potential is given to the pixel electrode.

If the digital video signal equivalent to 1 bit, which has been inputted during the writing period, turn the EL driving TFT 303 ON and the electric discharge TFT 304 OFF, the power supply electric potential of the power supply line Vi is given to the pixel electrode of the EL element 305 through the EL driving TFT 303 that is turned ON. As a result, the EL element 305 emits light.

On the other hand, if the digital video signal equivalent to 1 bit, which has been inputted during the writing period, turn the EL driving TFT 303 OFF and the electric discharge TFT 304 ON, the power supply electric potential of the power supply line Vi is not given to the pixel electrode of the EL element 305. As a result, the EL element 305 does not emit light. Then, due to the electric potential difference between the power supply electric potential of the power supply line Vi and the electric potential of the gate signal line Gj, a current flows between the power supply line Vi and the gate signal line Gj through a channel formation region of the electric discharge TFT 304. This current flows in the same direction as a current that flows in the power supply line Vi while the EL element emits light.

Preferably, the amount of current flowing into the channel formation region of the electric discharge TFT 304 when the electric discharge TFT 304 is ON, is the same as the amount of current flowing into a channel formation region of the EL driving TFT 303 when the EL element 305 emits light.

As the display period is finished, a writing period of the next sub-frame period is started to conduct the above operation again. However, digital video signals inputted to pixels in the writing period of the next sub-frame period are of the next bit.

When all of the sub-frame periods are finished, one frame period is completed.

Points at which a sub-frame periods are to turn up in one frame period and details about operation of the pixel 301 are the same as those of Embodiment Mode 1. Accordingly, explanations thereof are omitted here.

Although described in this embodiment is the case in which no EL elements emit light during any writing period, the present invention is not limited thereto. The EL elements may emit light to display an image during a writing period.

In this case, in the writing period, the electric potential difference between the power supply electric potential of the power supply line Vi and the opposite electric potential of the opposite electrode is set to a level that allows the EL element 305 to emit light when the power supply electric potential is given to the pixel electrode. Lengths of the display periods Td1 to Tdn may not satisfy Td1:Td2:Tdn=$2^0$:$2^1$: . . . :$2^{n-1}$ but instead lengths of sub-frame periods SF1 to SFn are set to meet SF1:SF2: . . . :SFn=$2^0$:$2^1$: . . . :$2^{n-1}$.

Current controlling elements may be provided in this embodiment mode as in Embodiment Mode 2. If current controlling elements are used in this embodiment mode, one is placed between the source region or the drain region of the electric discharge TFT 304 and the power supply line Vi, and another is placed between the source region or the drain region of the electric discharge TFT 304 and the gate signal line Gj. The current controlling element may be provided only at the source region side of the electric discharge TFT 304 or only at the drain region side thereof. Alternatively, two or more current controlling elements may be provided at the source region side of the electric discharge TFT 304 or two or more at the drain region side thereof.

With the current controlling elements, the amount of current flowing into the channel formation region of the electric discharge TFT 304 approaches to the amount of current flowing into a channel formation region of the EL driving TFT 303 when the EL element 305 emits light even if the power supply electric potential of the power supply line Vi and the electric potential of the gate signal line Gj are fixed while the electric discharge TFT 304 is ON.

The gate signal line connected to the source region or the drain region of the electric discharge TFT 304 may be a gate signal line of another pixel. In a driving method in which EL elements emit light also in writing periods, in particular, the source region or the drain region of the electric discharge TFT 304 is preferably connected to a gate signal line G(j−1) of the previous stage because the electric potential of the gate signal line G(j−1) of the previous stage has already been set constant when the gate signal line Gj is selected.

According to the present invention, a current flows between a power supply line and a gate signal line through an electric discharge TFT even in a pixel whose EL element is not emitting light. Therefore, variation of the difference in electric potential over the length of a power supply line depending on an image to be displayed is contained. Thus reduced is the difference in amount of current flowing into EL elements in adjacent pixels while the EL elements emit light. The difference in luminance between the adjacent pixels are accordingly reduced and crosstalk can be avoided.

Unlike the pixel shown in Embodiment Mode 1, the pixel of this embodiment mode has no reference power supply line and therefore the yield can be raised. The pixel according to this embodiment mode can provide higher aperture ratio than the pixel of Embodiment Mode 1 if the EL elements emit light toward the substrate. When the aperture ratio is raised, a pixel can provide higher luminance with the same amount of current flowing into its EL element.

[Embodiment Mode 4]

This embodiment mode gives a description on the structure of the pixel in the light emitting device shown in FIG. 1 when the power supply, that gives the opposite electrode of the EL element an electric potential, is connected to the source region or the drain region of the electric discharge TFT without using the reference power supply line Cj.

Figure 5:
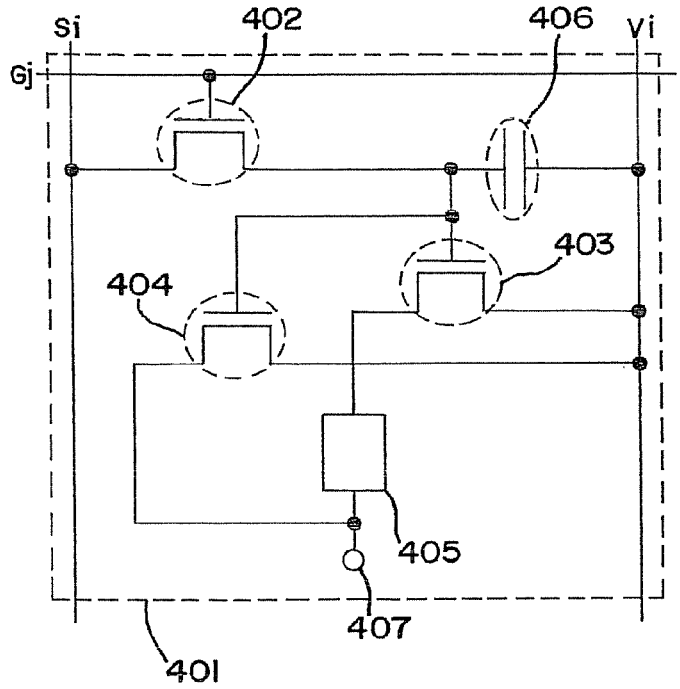
FIG. 5 is a circuit diagram of a pixel in a light emitting device of the present invention.

FIG. 5 shows the structure of a pixel according to this embodiment mode. A pixel 401 has a source signal line Si (one of source signal lines S1 to Sx), a power supply line Vi (one of power supply lines V1 to Vx), and a gate signal line Gj (one of gate signal lines G1 to Gy). The pixel 401 also has a switching TFT 402, an EL driving TFT 403, an electric discharge TFT 404, an EL element 405, and a capacitor 406.

The polarity of the EL driving TFT 403 is reverse to the polarity of the electric discharge TFT 404. Accordingly, the electric discharge TFT 404 is a p-channel TFT when the EL driving TFT 403 is an n-channel TFT. On the other hand, the electric discharge TFT 404 is an n-channel TFT when the EL driving TFT 403 is a p-channel TFT.

A gate electrode of the switching TFT 402 is connected to the gate signal line Gj. The switching 402 has a source region and a drain region, one of which is connected to the source signal line Si and the other of which is connected to a gate electrode of the EL driving TFT 403 and to a gate electrode of the electric discharge TFT 404.

The capacitor 406 is placed between the gate electrodes of the EL driving TFT 403 and of the electric discharge TFT 404 and the power supply line Vi. The capacitor 406 is provided to hold the electric potential of the gate electrodes of the EL driving TFT 403 and of the electric discharge TFT 404 when the switching TFT 402 is not selected (OFF state).

The EL driving TFT 403 has a source region connected to the power supply line Vi, and has a drain region connected to a pixel electrode of the EL element 405.

In this embodiment mode, the electric discharge TFT 404 has a source region and a drain region, one of which is connected to the power supply line Vi and the other of which is connected to a power supply 407 that is connected to an opposite electrode of the EL element 405 (opposite power supply).

The EL element 405 is composed of an anode, a cathode, and an EL layer that is interposed between the anode and the cathode. When the anode is connected to the drain region of the EL driving TFT 403, the anode serves as the pixel electrode whereas the cathode serves as the opposite electrode. When the cathode is connected to the drain region of the EL driving TFT 403, on the other hand, the cathode serves as the pixel electrode whereas the anode serves as the opposite electrode.

The opposite electrode of the EL element 405 receives an electric potential (opposite electric potential) from the opposite power supply 407 which is provided outside the EL panel. The opposite electric potential is also given to one of the source region and the drain region of the electric discharge TFT 404, that is connected to the opposite power supply 407. The power supply line Vi also receives an electric potential (power supply electric potential) from a power supply which is provided outside the EL panel.

The operation of the pixel 401 shown in FIG. 5 will be described next. Similar to Embodiment Mode 1, a plurality of sub-frame periods are provided in one frame period in this embodiment mode. The operation of each pixel in one sub-frame period is described while distinguishing the operation in a writing period from the operation in a display period.

First, in a writing period, the power supply electric potential of the power supply line Vi is kept at the same level as the opposite electric potential of the opposite electrode. Strictly speaking, the electric potential difference between the power supply electric potential of the power supply line Vi and the opposite electric potential of the opposite electrode is set to a level that does not allow the EL element 405 to emit light when the power supply electric potential is given to the pixel electrode.

The gate signal lines G1 to Gy are sequentially selected by input of selection signals until all of them in a pixel portion are selected once. While the respective gate signal lines are selected, digital video signals associated with the respective pixels are inputted to the source signal lines S1 to Sx. More detailed description will be given on the operation of the pixels in the writing period taking as an example the pixel that has the source signal line Si and the gate signal line Gj.

The gate signal line Gj is selected by input of a selection signal to the gate signal line Gj. Then, every switching TFT 402 which has a gate electrode connected to the gate signal line Gj is turned ON.

A digital video signal equivalent to 1 bit is inputted to the source signal line Si and then inputted, through the switching TFT 402 that has been turned ON, to the gate electrodes of the EL driving TFT 403 and of the electric discharge TFT 404.

The digital video signal equivalent to 1 bit has information of '1' or '0'. With the information of '1' or '0' carried by the digital video signal equivalent to 1 bit, switching of the EL driving TFT 403 and the electric discharge TFT 404 is controlled. Since the polarity of the EL driving TFT 403 is reverse to the polarity of the electric discharge TFT 404, the electric discharge TFT 404 is turned OFF when the EL driving TFT 403 is turned ON whereas the electric discharge TFT 404 is turned ON when the EL driving TFT 403 is turned OFF.

The writing period is finished as the digital video signals equivalent to 1 bit are inputted to all of the pixels.

After the writing period is finished, a display period is started. In the display period, the level of the opposite electric potential of the opposite electrode is changed so that the electric potential difference between the power supply electric potential of the power supply line Vi and the opposite electric potential of the opposite electrode is set to a level that allows the EL element 405 to emit light when the power supply electric potential is given to the pixel electrode.

If the digital video signal equivalent to 1 bit, which has been inputted during the writing period, turn the EL driving TFT 403 ON and the electric discharge TFT 404 OFF, the power supply electric potential of the power supply line Vi is given to the pixel electrode of the EL element 405 through the EL driving TFT 403 that is turned ON. As a result, the EL element 405 emits light.

On the other hand, if the digital video signal equivalent to 1 bit, which has been inputted during the writing period, turn the EL driving TFT 403 OFF and the electric discharge TFT 404 ON, the power supply electric potential of the power supply line Vi is not given to the pixel electrode of the EL element 405. As a result, the EL element 405 does not emit light. Then, due to the electric potential difference between the power supply electric potential of the power supply line Vi and the opposite electric potential, a current flows between the power supply line Vi and the opposite power supply through a channel formation region of the electric discharge TFT 404. This current flows in the same direction as a current that flows in the power supply line Vi while the EL element 405 emits light.

Preferably, the amount of current flowing into a channel formation region of the electric discharge TFT 404 while the electric discharge TFT 404 is ON is the same as the amount of current flowing into a channel formation region of the EL driving TFT 403 while the EL element 405 emits light.

As the display period is finished, a writing period of the next sub-frame period is started to conduct the above operation again. However, digital video signals inputted to pixels in the writing period of the next sub-frame period are of the next bit.

When all of the sub-frame periods are finished, one frame period is completed.

Points at which n sub-frame periods are to turn up in one frame period and details about operation of the pixel 401 are the same as Embodiment Mode 1. Accordingly, explanations thereof are omitted here.

Although described in this embodiment mode is the case in which no EL elements emit light during any writing period, the present invention is not limited thereto. The EL elements may emit light to display an image during a writing period.

In this case, in the writing period, the electric potential difference between the power supply electric potential of the power supply line Vi and the opposite electric potential of the opposite electrode is set to a level that allows the EL element 405 to emit light when the power supply electric potential is given to the pixel electrode. Lengths of the display periods Td1 to Tdn may not satisfy Td1:Td2: . . . :Tdn=$2^0$:$2^1$: . . . :$2^{n-1}$ but instead lengths of sub-frame periods SF1 to SFn are set to meet SF1:SF2: . . . :SFn=$2^0$:$2^1$: . . . :$2^{n-1}$.

Current controlling elements may be provided in this embodiment mode as in Embodiment Mode 2. If current controlling elements are used in this embodiment, one is placed between the source region or the drain region of the electric discharge TFT 404 and the power supply line Vi, and another is placed between the source region or the drain region of the electric discharge TFT 404 and the opposite electrode. The current controlling element may be provided only at the source region side of the electric discharge TFT 404 or only at the drain region side thereof. Alternatively, two or more current controlling elements may be provided at the source region side of the electric discharge TFT 404 or two or more at the drain region side thereof.

With the current controlling elements, the amount of current flowing into the channel formation region of the electric discharge TFT 404 approaches to the amount of current flowing into the channel formation region of the EL driving TFT 403 while the EL element 405 emits light even if the power supply electric potential of the power supply line Vi and the opposite electric potential are fixed while the electric discharge TFT 404 is ON.

According to the present invention, a current flows between a power supply line and an opposite power supply through an electric discharge IP even in a pixel whose EL element is not emitting light at the moment. Therefore variation of the difference in electric potential over the length of a power supply line depending on an image to be displayed is contained. Thus reduced is the difference in amount of current flowing into EL elements in adjacent pixels while the EL elements emit light. The difference in luminance between the adjacent pixels are accordingly reduced and crosstalk can be avoided.

Unlike the pixel shown in Embodiment Mode 1, the pixel of this embodiment mode has no reference power supply line and therefore the yield can be raised. The pixel according to this embodiment mode can provide higher aperture ratio than the pixel of Embodiment Mode 1 if the EL elements emit light toward the substrate. When the aperture ratio is raised, a pixel can provide higher luminance with the same amount of current flowing into its EL element.

In all embodiment modes, the EL driving TFT is preferably a p-channel TFT if the anode serves as the pixel electrode and the cathode serves as the opposite electrode. On the other hand, if the cathode serves as the pixel electrode while the anode serves as the opposite electrode, the EL driving TFT is preferably an n-channel TFT.

Embodiments of the present invention will be described below.

[Embodiment 1]

This embodiment describes a case of using resistors for the current controlling elements of the pixel shown in FIG. 3.

Figure 6:
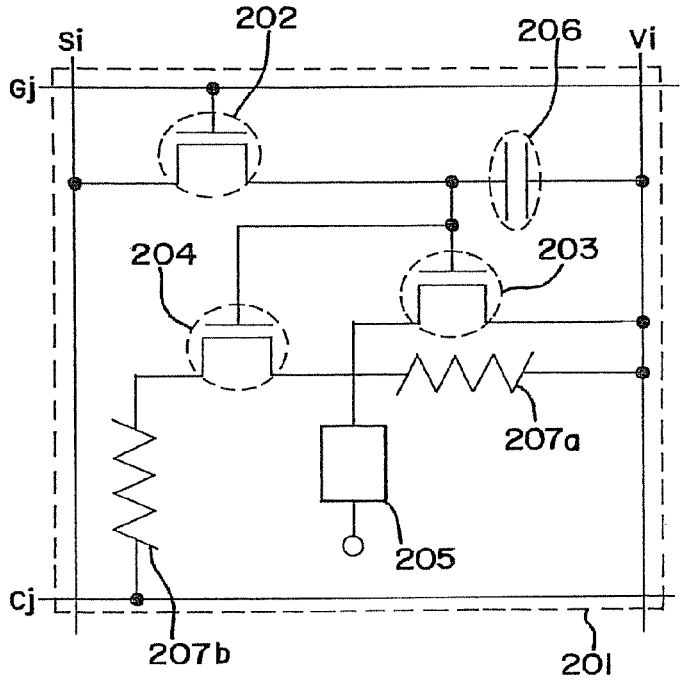
FIG. 6 is a circuit diagram of a pixel in a light emitting device of the present invention.

FIG. 6 shows the structure of a pixel according to this embodiment. The components shown in FIG. 3 are denoted by the same symbols. In this embodiment, resistors (current controlling resistors) are used for the current controlling elements 207*a* and 207*b* shown in FIG. 3.

The current controlling resistors 207*a* and 207*b* can be formed at the same time when the switching TFT 202, the EL driving TFT 203, and the electric discharge TFT 204 are formed. Therefore providing the current controlling resistors 207*a* and 207*b* does not lead to an increase in number of manufacture steps.

The current controlling resistors 207*a* and 207*b* can control the amount of current flowing into the channel formation region of the electric discharge TFT 204. Accordingly, with the current controlling resistors 207*a* and 207*b*, the amount of current flowing into the channel formation region of the electric discharge TFT 204 approaches to the amount of current flowing into the channel formation region of the EL driving TFT 203 while the EL element 205 emits light even if the power supply electric potential of the power supply line Vi and the reference electric potential of the reference power supply line Cj are fixed while the electric discharge TFT 204 is ON.

Although a current controlling resistor is provided at each side of the electric discharge TFT 204, namely, the source region side and the drain region side in this embodiment, the present invention is not limited thereto. The current controlling element may be provided only at the source region side of the electric discharge TFT 204 or only at the drain region side thereof. Alternatively, two or more current controlling resistors may be provided at the source region side of the electric discharge TFT 204 or two or more at the drain region side thereof.

The current controlling resistors used in this embodiment may be provided as current controlling elements in the pixels shown in FIGS. 4 and 5.

The current controlling elements of the present invention are not limited to the structure shown in this embodiment. Any element can be used for the current controlling elements of the present invention as long as it is capable of controlling the amount of current.

[Embodiment 2]

This embodiment describes a case of using diodes for the current controlling elements of the pixel shown in FIG. 3.

Figure 7:
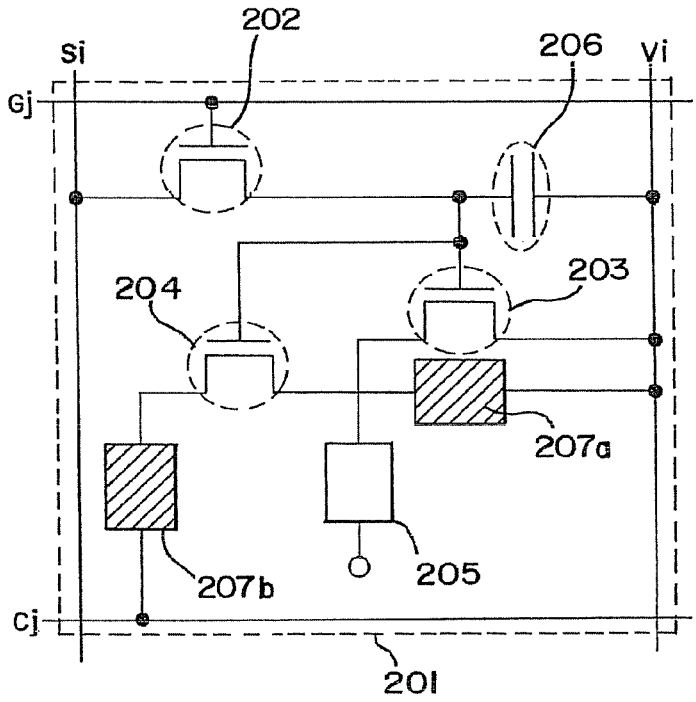
FIG. 7 is a circuit diagram of a pixel in a light emitting device of the present invention.

FIG. 7 shows the structure of a pixel according to this embodiment. The components shown in FIG. 3 are denoted by the same symbols. In this embodiment, diodes (current controlling diodes) are used for the current controlling elements 207*a* and 207*b* shown in FIG. 3.

The current controlling diodes 207*a* and 207*b* are semiconductor diodes which have a rectifying function that allows a current to flow in one direction only. Examples of diodes usable as the current controlling diodes 207*a* and 207*b* include pn junction diodes that utilize pn junction, pin junction diodes that utilize pin junction, Schottky diodes that utilize contact between a metal and a semiconductor, and MOS diodes (MOS elements).

The current controlling diodes 207*a* and 207*b* are connected so as to set the flow of the current running into the channel formation region of the electric discharge TFT 204 as the forward direction.

The current controlling diodes 207*a* and 207*b* can be formed at the same time when the switching TFT 202, the EL driving TFT 203, and the electric discharge TFT 204 are formed. Therefore providing the current controlling diodes 207*a* and 207*b* does not lead to an increase in number of manufacture steps.

The current controlling diodes 207*a* and 207*b* can control the amount of current flowing into the channel formation region of the electric discharge TFT 204. Accordingly, with the current controlling diodes 207*a* and 207*b*, the amount of current flowing into the channel formation region of the electric discharge TFT 204 approaches to the amount of current flowing into the channel formation region of the EL driving TFT 203 while the EL element 205 emits light even if the power supply electric potential of the power supply line Vi and the reference electric potential of the reference power supply line Cj are fixed while the electric discharge TFT 204 is ON.

Although a current controlling diode is provided at each side of the electric discharge TFT 204, namely, the source region side and the drain region side in this embodiment, the present invention is not limited thereto. The current controlling element may be provided only at the source region side of the electric discharge TFT 204 or only at the drain region side thereof. Alternatively, two or more current controlling diodes may be provided at the source region side of the electric discharge TFT 204 or two or more on the drain region side thereof.

The current controlling diodes used in this embodiment may be provided as current controlling elements in the pixels shown in FIGS. 4 and 5.

When the gate signal line substitutes for the reference power supply line as in FIG. 4, the electric potential of the selected gate signal line is sometimes lower than the power supply electric potential even though the opposite electric potential is higher than the power supply electric potential and it is also possible for the electric potential of the selected gate signal line to be higher than the power supply electric potential even though the opposite electric potential is lower than the power supply electric potential. In this case, the current, that is to flow into the channel formation of the electric discharge TFT, flows from the source region to the drain region when the electric discharge TFT is an n-channel TFT, or from the drain region to the source region when the electric discharge TFT is a p-channel TFT. Providing the current controlling diodes are especially effective in avoiding this.

The current controlling elements of the present invention are not limited to the structure shown in this embodiment. Any element can be used for the current controlling elements of the present invention as long as it is capable of controlling the amount of current.

This embodiment may be combined with the structure of Embodiment 1.

[Embodiment 3]

This embodiment describes a case of using TFTs for the current controlling elements of the pixel shown in FIG. 3.

Figure 8:
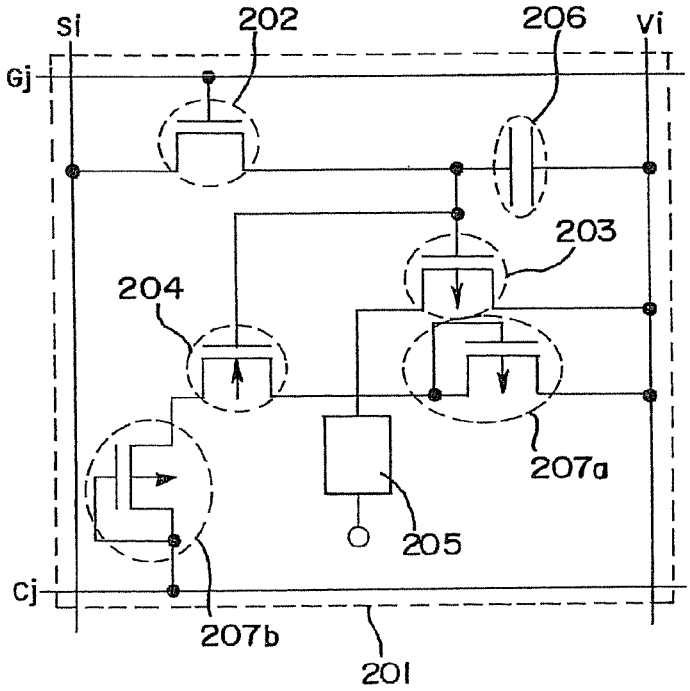
FIG. 8 is a circuit diagram of a pixel in a light emitting device of the present invention.

FIG. 8 shows the structure of a pixel according to this embodiment. The components shown in FIG. 3 are denoted by the same symbols. In this embodiment, however, the EL driving TFT 203 is a p-channel TFT and the electric discharge TFT 204 is an n-channel TFT for the sake of simpler explanation.

This embodiment uses TFTs (current controlling TFTs) for the current controlling elements 207*a* and 207*b* shown in FIG. 3. In FIG. 8, the current controlling TFTs are p-channel TFTs.

The current controlling TFT 207*a* has a source region and a drain region one of which is connected to the power supply line Vi and the other of which is connected to the drain region of the electric discharge TFT. The current controlling TFT 207*b* has a source region and a drain region one of which is connected to the reference power supply line Cj and the other of which is connected to the source region of the electric discharge TFT.

The electric potential of the gate electrodes of the current controlling elements 207*a* and 207*b* are kept at the same level as the electric potential of the drain regions of the current controlling elements 207*a* and 207*b*. Therefore, when the electric discharge TFT is turned ON, the current, that is to flow into the channel formation of the electric discharge TFT, flows from the drain region to the source region when the electric discharge TFT is an n-channel TFT or from the source region to the drain region when the electric discharge TFT is a p-channel The current controlling TFTs 207*a* and 207*b* can be formed at the same time when the switching TFT 202, the EL driving TFT 203, and the electric discharge TFT 204 are formed. Therefore providing the current controlling TFTs 207*a* and 207*b* does not lead to an increase in number of manufacture steps.

The current controlling TFTs 207*a* and 207*b* can control the amount of current flowing into the channel formation region of the electric discharge TFT 204. Accordingly, with the current controlling TFTs 207*a* and 207*b*, the amount of current flowing into the channel. formation region of the electric discharge TFT 204 approaches to the amount of current flowing into the channel formation region of the EL driving TFT 203 during the EL element 205 emits light even if the power supply electric potential of the power supply line Vi and the reference electric potential of the reference power supply line Cj are fixed while the electric discharge TFT 204 is ON.

Although a current controlling TFT is provided at each side of the electric discharge TFT 204, namely, the source region side and the drain region side in this embodiment, the present invention is not limited thereto. The current controlling element may be provided only at the source region side of the electric discharge TFT 204 or only at the drain region side thereof. Alternatively, two or more current controlling TFTs may be provided at the source region side of the electric discharge TFT 204 or two or more at the drain region side thereof.

Figure 9:
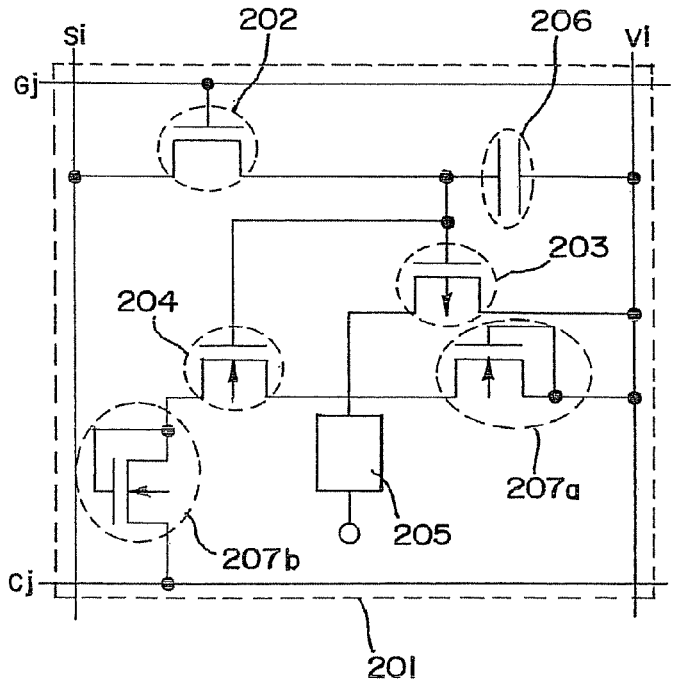
FIG. 9 is a circuit diagram of a pixel in a light emitting device of the present invention.

The current controlling TFTs of this embodiment may not always be limited to p-channel TFTs. FIG. 9 shows the structure of a pixel when the current controlling TFTs are n-channel In FIG. 9, gate electrodes of the current controlling TFTs 207*a* and 207*b* are kept at the same level of electric potential as drain regions of the current controlling TFTs 207*a* and 207*b*, which is similar to FIG. 8.

Although described in this embodiment is the case in which the EL driving TFT 203 is a p-channel TFT and the electric discharge TFT 204 is an n-channel TFT, this embodiment is not limited thereto. The current controlling TFTs can also be used as the current controlling elements when the EL driving TFT 203 is an n-channel TFT and the electric discharge TFT 204 is a p-channel TFT.

The current controlling TFTs used in this embodiment may be provided as current controlling elements in the pixels shown in FIGS. 4 and 5.

When the gate signal line substitutes for the reference power supply line as in FIG. 4, the electric potential of the selected gate signal line is sometimes lower than the power supply electric potential even though the opposite electric potential is higher than the power supply electric potential and it is also possible for the electric potential of the selected gate signal line to be higher than the power supply electric potential even though the opposite electric potential is lower than the power supply electric potential. In this case, the current that is to flow into the channel formation of the electric discharge TFT flows from the source region to the drain region when the electric discharge TFT is an n-channel TFT or from the drain region to the source region when the electric discharge TFT is a p-channel TFT. Providing the current controlling TFTs are especially effective in avoiding this.

The current controlling elements of the present invention are not limited to the structure shown in this embodiment. Any element can be used for the current controlling elements of the present invention as long as it is capable of controlling the amount of current.

This embodiment may be combined with the structure of Embodiment 1 or 2.

[Embodiment 4]

This embodiment describes an order of sub-frame periods SF1 to SFn which turn up in driving a light emitting device of the present invention for n bit digital video signals.

Figure 10:
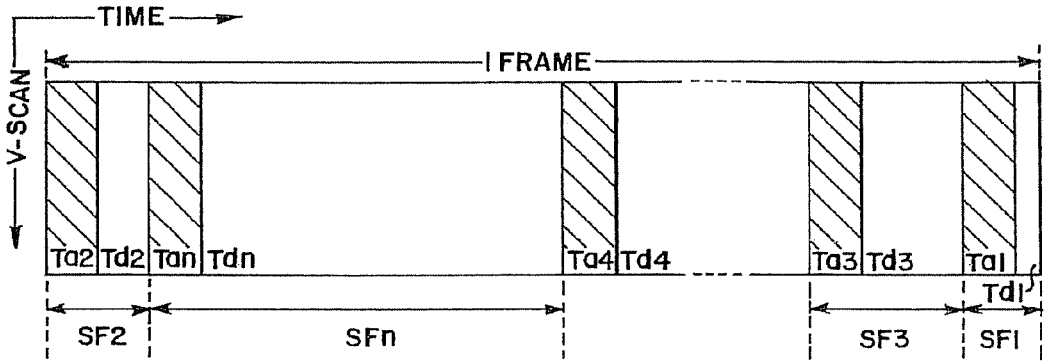
FIG. 10 is a diagram showing a method of driving alight emitting device according to the present invention.

FIG. 10 shows points at which n writing periods (Ta1 to Tan) and n display periods (Td1 to Tdn) turn up in one frame period. The axis of abscissa indicates time whereas the axis of ordinate indicates the position of a gate signal line of a pixel. Descriptions on details about how pixels are driven are can be found in Embodiment Modes, and omitted here.

According to a driving method of this embodiment, the sub-frame period that has the longest display period in one frame period (in this embodiment, SFn) does not come first or last in the one frame period. In other words, the sub-frame period that has the longest display period in one frame period is interposed between other sub-frame periods of the same frame period.

This makes it difficult for the human eye to recognize uneven display caused by light emission of adjacent display periods in adjacent frame periods when an image is displayed with intermediate gray scales.

Although described in this embodiment is the case in which no EL elements emit light during any writing period, the present invention is not limited thereto. The EL elements may emit light to display an image during a writing period.

In this case, the electric potential difference between the power supply electric potential of the power supply line Vi and the opposite electric potential of the opposite electrode is set to a level that allows an EL element to emit light when the power supply electric potential is given to the pixel electrode. Lengths of the display periods Td1 to Tdn may not satisfy Td1:Td2: . . . :Tdn=$2^0$:$2^1$: . . . :$2^{n-1}$ but instead lengths of the sub-frame periods SF1 to SFn are set to meet SF1: SF2: . . . :SFn=$2^0 2^1$: . . . $2^{n-1}$.

The structure of this embodiment is effective when n≧3. This embodiment may be combined freely with Embodiments 1 through 3.

[Embodiment 5]

This embodiment describes a case of driving a light emitting device of the present invention using 6 bit digital video signals.

Figure 11:
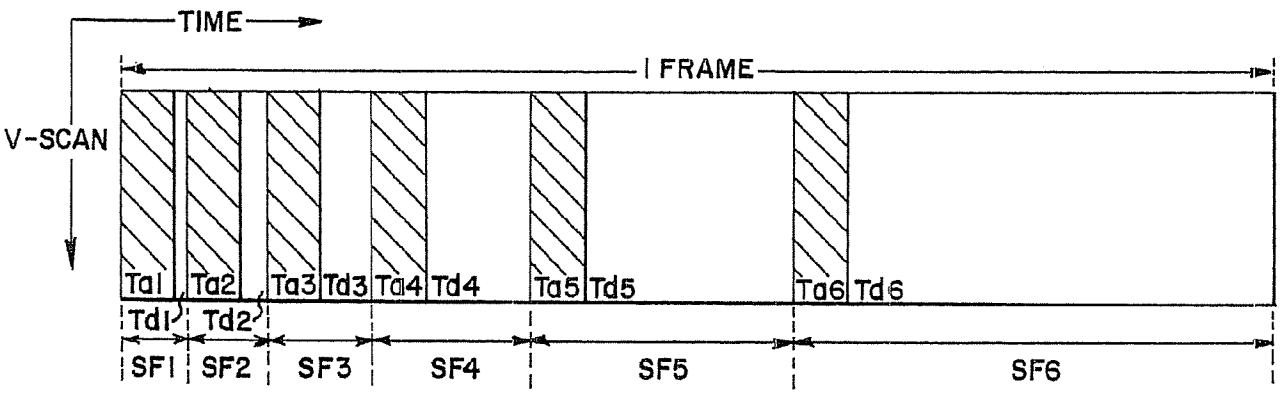
FIG. 11 is a diagram showing a method of driving a light emitting device according to the present invention.

FIG. 11 shows points at which 6 writing periods (Ta1 to Ta6) and 6 display periods (Td1 to Td6) turn up in one frame period. The axis of abscissa indicates time whereas the axis of ordinate indicates the position of a gate signal line of a pixel. Descriptions on details about how pixels are driven can be found in Embodiment Modes, and are omitted here.

When the light emitting device is driven using 6 bit digital video signals, at least 6 sub-frame periods SF1 to SF6 are provided in one frame period.

The sub-frame periods SF1 to SF6 are associated with the respective bits of 6 bit digital signals. The sub-frame periods SF1 to SF6 have 6 writing periods (Ta1 to Ta6) and 6 display periods (Td1 to Td6).

A sub-frame period SFm (m is an arbitrary number out of 1 through 6) has a writing period Tam and a display period Tdm that are associated with m bit digital signal. The writing period Tam is followed by a display period that is associated with the same bit number, in this case, the display period Tdm.

The writing periods Ta and the display periods Td are repeated in one frame period to display on image.

Lengths of the display periods Td1 to Td6 are set to satisfy Td1:Td2: . . . :Td6=$2^0$:$2^1$:$2^5$.

In the driving method according to the present invention, gray scales are obtained by controlling the sum of lengths of display periods in one frame period during which light is emitted.

Although described in this embodiment is the case in which no EL elements emit light during any writing period, the present invention is not limited thereto. The EL elements may emit light to display an image during a writing period.

In this case, the electric potential difference between the power supply electric potential of the power supply line Vi and the opposite electric potential of the opposite electrode is set to a level that allows an EL element to emit light when the power supply electric potential is given to the pixel electrode. Lengths of the display periods Td1 to Td6 may not satisfy Td1:Td2: . . . :Td6=$2^0$:$2^1$: . . . :$2^5$ but instead lengths of the sub-frame periods SF1 to SF6 are set to meet SF1: SF2: . . . :SF6=$2^0$:$2^1$: . . . :$2^5$.

This embodiment may be combined freely with Embodiments 1 through 4.

[Embodiment 6]

This embodiment gives a description on an example of a driving method which is different from FIG. 2 and uses n-bit digital video signals.

Figure 12:
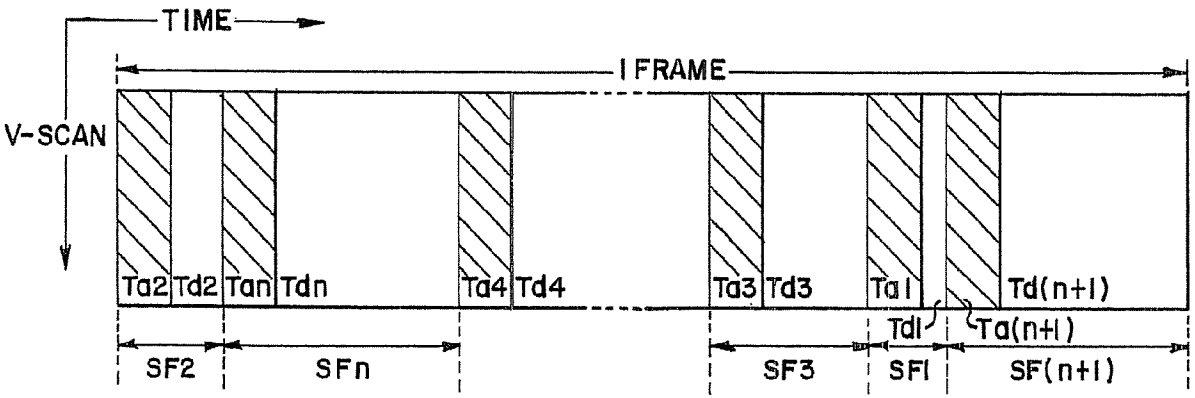
FIG. 12 is a diagram showing a method of driving a light emitting device according to the present invention.

FIG. 12 is a timing diagram of (n+1) writing periods (Ta1 to Ta(n+1)) and n display periods (Td1 to Td(n+1)) in one frame period. The horizontal axis indicates time and the vertical axis indicates the position of gate signal lines of pixels. It is described in Embodiment Mode in detail how pixels are driven and the explanation is therefore omitted here.

In this embodiment, one frame period has (n+1) sub-frame periods, SF1 to SF(n+1), in accordance with n bit digital video signals. The sub-frame periods SF1 to SF(n+1) have (n+1) writing periods (Ta1 to Ta(n+1)) and n display periods (Td1 to Td(n+1)).

A writing period Tam (m is an arbitrary number from 1 to n+1) and a display period Tdm make a sub-frame period SFm. The writing period Tam is followed by a display period that is corresponding to the digital video signal of the same bit, in this case, the display period Tdm.

The sub-frame periods SF1 to SF(n−1) are corresponding to 1 to (n−1) bit digital video signals, respectively. The sub-frame periods SFn and SF(n+1) are corresponding to an n bit digital video signal.

The sub-frame periods SFn and SF(n+1) that are corresponding to the digital video signal of the same bit do not immediately follow each other in this embodiment. In other words, the sub-frame periods SFn and SF(n+1) that are corresponding to the digital video signal of the same bit sandwich another sub-frame period.

The writing period Ta and the display period Td are repeatedly in one frame period to display one image.

The length of the display periods Td1 to Td(n+1) is set so as to satisfy Td1:Td2: x x x :(Tdn+Td(n+1))=$2^0$:$2^1$: x x x :$2^{n-1}$.

According to the driving method of the present invention, gay scale display is obtained by controlling the total light emission time of a pixel in one frame period.

The above structure makes the uneven display in middle gray scale display less recognizable to the human eye than in FIGS. 2 and 10. The uneven display is caused by adjoining display periods during which light is emitted in adjacent frame periods.

Described in this embodiment is the case in which two sub-frame periods are provided for the digital video signal of the same bit. However, the present invention is not limited thereto. Three or more sub-frame periods may be provided for the digital video signal of the same bit in one frame period.

Although a plurality of sub-frame periods are provided for the most significant bit digital video signal in this embodiment, the present invention is not limited thereto. A digital video signal of other bit except for the most significant bit may have a plurality of sub-frame periods. There is no need to limit the number of bits that can have a plurality of sub-frame periods to one. A digital video signal of certain bit and a digital video signal of another bit can respectively have plural sub-frame periods.

Although described in this embodiment is the case in which no EL elements emit light during any writing period, the present invention is not limited thereto. The EL elements may emit light to display an image during a writing period.

In this case, the electric potential difference between the power supply electric potential of the power supply line Vi and the opposite electric potential of the opposite electrode is set to a level that allows an EL element to emit light when the power supply electric potential is given to the pixel electrode. Lengths of the display periods Td1 to Td(n+1) may not satisfy Td1 :Td2: . . . :(Tdn+Td(n+1))=$2^0$:$2^1$: . . . $2^{n-1}$ but instead lengths of the sub-frame periods SF1 to SFn are set to meet SF1:SF2: . . . :(SFn+SF(n+1))=$2^0$:$2^1$: . . . :$2^{n-1}$.

The structure of this embodiment is effective when n≦2. This embodiment can be combined freely with Embodiments 1 and 5.

[Embodiment 7]

This embodiment gives a description on a method of manufacturing TFTs for a pixel portion (a switching TFT 5100, a discharge TFT 5101, and an EL driving TFT 5102) of a light emitting device according to the present invention. TFTs for driving circuits (a source signal line driving circuit, a writing gate signal line driving circuit, and a display gate signal line driving circuit) provided in the periphery of the pixel portion may be formed on the same substrate on which the TFTs for the pixel portion are placed at the same time the pixel portion TFTs are formed.

Figures 13A, 13B, 13C:
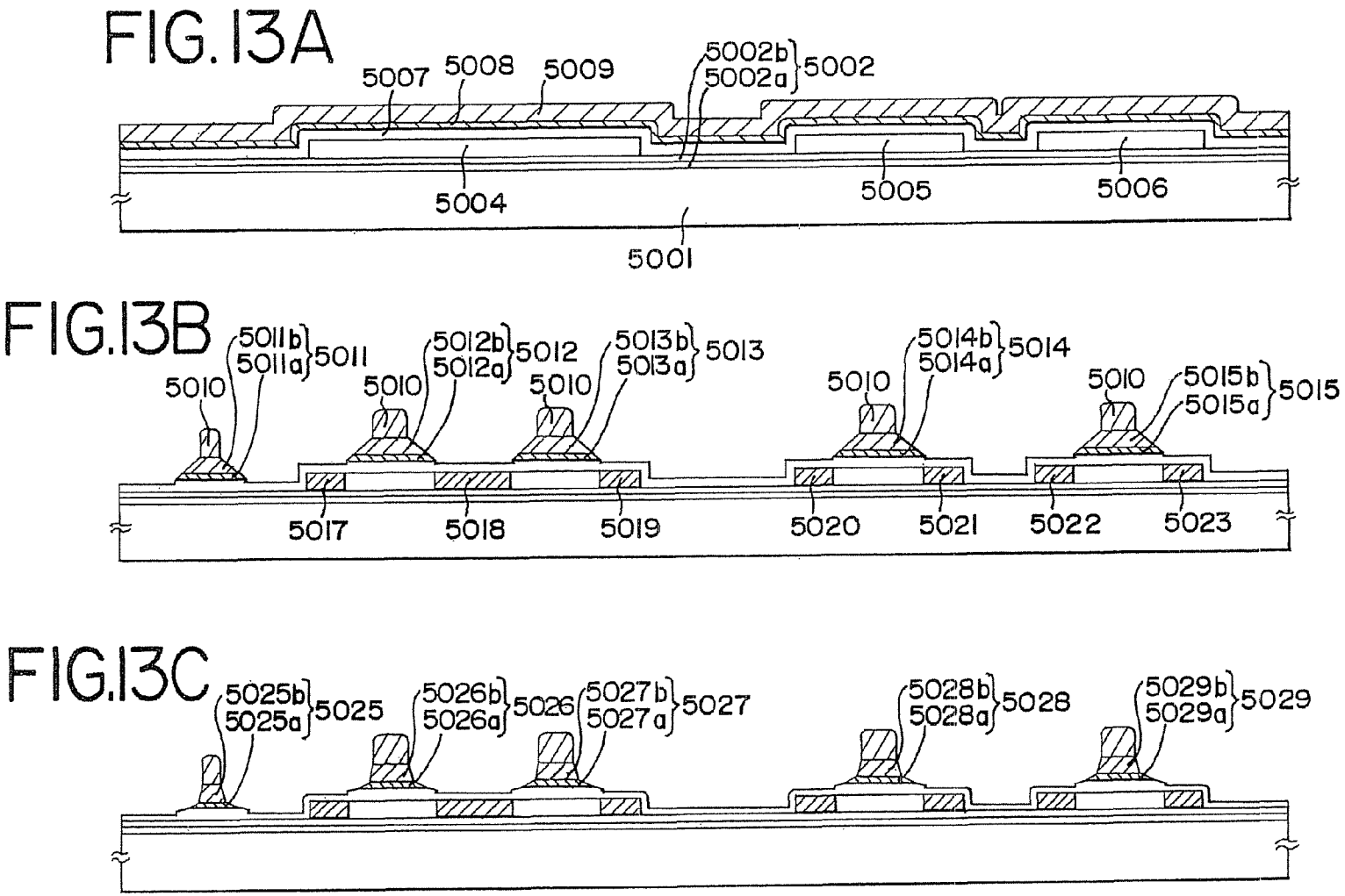
FIGS. 13A to 13C are diagrams showing a method of manufacturing a light emitting device.

First, as shown in FIG. 13A, a base film 5002 is formed from an insulating film such as a silicon oxide film, a silicon nitride film, and a silicon oxynitride film on a glass substrate 5001. The substrate 5001 is formed of barium borosilicate glass typical example of which is Corning #7059 glass or Corning #1737 glass (product of Corning Incorporated), or of aluminoborosilicate glass. The base film 5002 is, for example, a laminate of a silicon oxynitride film 5002*a* that is formed from $SiH_4$, $NH_3$, and $N_2O$ by plasma CVD to a thickness of 10 to 200 nm (preferably 50 to 100 nm) and a silicon oxynitride hydride film 5002*b* formed from $SiH_4$ and $N_2O$ by plasma CVD to a thickness of 50 to 200 nm (preferably 100 to 150 nm). Although the base film 5002 in this embodiment has a two-layer structure, it may be a single layer of one of the insulating films given in the above, or a laminate of two or more layers of those insulating films.

A semiconductor film having an amorphous structure is crystallized by laser crystallization or a known thermal crystallization method to form a crystalline semiconductor film. The crystalline semiconductor film makes island-like semiconductor layers 5004 to 5006. The island-like semiconductor layers 5004 to 5006 each have a thickness of 25 to 80 nm (preferably 30 to 60 nm). No limitation is put on the choice of material of the crystalline semiconductor film but it is preferable to use silicon or a silicon germanium (SiGe) alloy.

When the crystalline semiconductor film is formed by laser crystallization, a pulse oscillation-type or continuous wave excimer laser, YAG laser, or $YVO_4$ laser is used. Laser light emitted from a laser as those given in the above is desirably collected into a linear beam by an optical system before irradiating the semiconductor film. Conditions of crystallization are set suitably by an operator. However, if an excimer laser is used, the pulse oscillation frequency is set to 300 Hz and the laser energy density is set to 100 to 400 mJ/$cm^2$ (typically 200 to 300 mJ/$cm^2$). If a YAG laser is used, second harmonic thereof is employed and the pulse oscillation frequency is out to 30 to 300 kHz while setting the laser energy density to 300 to 600 mJ/$cm^2$ (typically 350 to 500 mJ/$cm^2$). The laser light is collected into a linear beam having a width of 100 to 1000 μm, for example, 400 μm, to irradiate the entire substrate. The substrate is irradiated with the linear laser light with the beams overlapping each other at an overlap ratio of 50 to 90%.

The laser can use a gaseous laser of a continuous oscillation or a pulse ocsillation, or the solid laser. The gaseous laser includes the excimer laser, the Ar laser, the Kr laser and the like. The solid laser includes the YAG laser, the YVO, laser, the YLF laser, the $YAlO_3$ laser, the glass laser, the ruby laser, the Alexandrite laser, the Ti: sapphire laser and the like. The laser, which uses crystals such as YAG, $YVO_4$, YLF, and $YAlO_3$ doped by Cr, Nd, Er, Ho, Ce, Co, Ti, and Tm, can be used. The fundamental harmonic of concerned laser differs according to the doped material, and the laser light having about 1 μm fundamental harmonic can be gained. The higher harmonic to the fundamental harmonic can be obtained by using a non-linear optical element.

At the crystallization of an amorphous silicon semiconductor film, it is preferable that the solid laser possible to continuous oscillate, and the second higher harmonic to the fourth higher harmonic of the fundamental harmonic is applied to obtain the crystals in big gain size. Typically, it is desirable to use the second higher harmonic (532 nm) of Nd: $YVO_4$ laser (fundamental harmonic: 1064 nm) and the third higher harmonic (355 nm). Specifically, the laser light shot from the $YVO_4$ laser of the continuous oscillation of 10 W output is converted to the higher harmonic by the non-line optical element. In addition, there is a method of put the $YVO_4$ crystal and the non-line optical element, and shooting the higher harmonic. It is desirable that the higher harmonic is molded into the rectangular shape or the oval shape by the optical system on the irradiation surface, and thus the harmonic is irradiated to the processed body. The amount of the energy density is necessary about 0.01 to 100 MW/$cm_2$ (preferably 0.1 to 100 MW/$cm_2$). And the harmonic is irradiated moving the semiconductor film 10 to 2000 cm/s speed relatively to the laser light.

Next, a gate insulating film 5007 is formed so as to cover the island-like semiconductor layers 5003 to 5006. The gate insulating film 5007 is formed from an insulating film containing silicon by plasma CVD or sputtering to a thickness of 40 to 150 nm. In this embodiment, a silicon oxynitride film having a thickness of 120 nm is used. Needless to say, the gate insulating film is not limited to a silicon oxynitride film but may be a single layer or a laminate of other insulating films containing silicon. For example; if a silicon oxide film is used for the gate insulating film, the film is formed by plasma CVD in which TEOS (tetraethyl orthosilicate) is mixed with $O_2$ and the reaction pressure is set to 40 Pa, the substrate temperature to 300 to 400° C., the frequency is set high to 13.56 MHZ, and the power density is set to 0.5 to 0.8 W/$cm^2$ for electric discharge. The silicon oxide film thus formed can provide the gate insulating film with excellent characteristics when it is subjected to subsequent thermal annealing at 400 to 500° C.

On the gate insulating film 5007, a first conductive film 5008 and a second conductive film 5009 for forming gate electrodes are formed. In this embodiment, the first conductive film 5008 is a Ta film with a thickness of 50 to 100 nm and the second conductive film 5009 is a W film with a thickness of 100 to 300 nm.

The Ta film is formed by sputtering in which Ta as a target is sputtered with Ar. In this case, an appropriate amount of Xe or Kr is added to Ar to ease the internal stress of the Ta film and thus prevent the Ta film from peeling off. The resistivity of a Ta film in α phase is about 20 μΩcm and is usable for a gate electrode. On the other hand, the resistivity of a Ta film in β phase is about 180 μΩcm and is not suitable for a gate electrode. A Ta film in α phase can readily be obtained when a base with a thickness of about 10 to 50 nm is formed from tantalum nitride that has a crystal structure approximate to that of the α phase Ta film.

The W film is formed by sputtering with W as a target. Alternatively, the W film may be formed by thermal CVD using tungsten hexafluoride ($WF_6$). In either case, the W film has to have a low resistivity in order to use the W film as a gate electrode. A desirable resistivity of the W film is 20 μΩcm or lower. The resistivity of the W film can be reduced by increasing the crystal grain size but, if there are too many impurity elements such as oxygen in the W film, crystallization is inhibited to raise the resistivity. Accordingly, when the W film is formed by sputtering, a W target with a purity of 99.9999% is used and a great care is taken not to allow impurities in the air to mix in the W film being formed. As a result, the W film can have a resistivity of 9 to 20 μΩcm.

Although the first conductive film 5008 is a Ta film and the second conductive film 5009 is a W film in this embodiment, there is no particular limitation. The conductive films may be formed of any element selected from the group consisting of Ta, W, Ti, Mo, Al, and Cu, or of an alloy material or compound material mainly containing the elements listed above. A semiconductor film, typically a polycrystalline silicon film doped with an impurity element such as phosphorus, may be used instead. Other desirable combinations of materials for the first and second conductive films than the one shown in this embodiment include: tantalum nitride (TaN) for the first conductive film 5008 and W for the second conductive film 5009; tantalum nitride (TaN) for the first conductive film 5008 and Al for the second conductive film 5009; and tantalum nitride (TaN) for the first conductive film 5008 and Cu for the second conductive film 5009. (FIG. 13A)

Next, a resist mask 5010 is formed to carry out first etching treatment for forming electrodes and wiring lines. In this embodiment, ICP (inductively coupled plasma) etching is employed in which $CF_4$ and $Cl_2$ are mixed as etching gas and an RF (13.56 MHZ) power of 500 W is given to a coiled electrode at a pressure of 1 Pa to generate plasma. The substrate side (sample stage) also receives an RF (13.56 MHZ) power of 100 W so that a substantially negative self-bias voltage is applied. When the mixture of $CF_4$ and $Cl_2$ is used, the W film and the Ta film are etched to the same degree.

Under the above etching conditions, if the resist mask is properly shaped, the first conductive film and the second conductive film are tapered around the edges by the effect of the bias voltage applied to the substrate side. The angle of the tapered portions is 15° to 45°. In order to etch the conductive films without leaving any residue on the gate insulating film, the etching time is prolonged by about 10 to 20%. The selective ratio of the W film to the silicon oxynitride film is 2 to 4 (typically 3), and therefore a region where the silicon oxynitride film is exposed is etched by about 20 to 50 nm by the over-etching treatment. In this way, first shape conductive layers 5011 to 5015 (first conductive layers 5011*a* to 5015*a* and second conductive layers 5011*b* to 5015*b*) are formed from the first conductive film and the second conductive film through the first etching treatment. At this point, regions of the gate insulating film 5007 that are not covered with the first shape conductive layers 5011 to 5015 are etched and thinned by about 20 to 50 nm.

First doping treatment is conducted next for doping of an impurity element that gives the n type conductivity. Ion doping or ion implanting is employed. In ion doping, the dose is set to $1\times10^{13}$ to $5\times10^{14}$ atoms/cm$^2$ and the acceleration voltage is set to 60 to 100 keV. The impurity element that gives the n-type conductivity is an element belonging to Group 15, typically, phosphorus (P) or arsenic (As). Here, phosphorus (P) is used. In this case, the conductive layers 5012 to 5015 serve as masks against the impurity element that gives then-type conductivity, and first impurity regions 5017 to 5023 are formed in a self-aligning manner. The first impurity regions 5017 to 5023 each contain the impurity element that gives then-hype conductivity in a concentration of $1\times10^{20}$ to $1\times10^{21}$ atoms/cm$^3$. (FIG. 13B)

Next, second etching treatment is conducted while leaving the resist mask in place as shown in FIG. 13C. $CF_4$, $Cl_2$, and $O_2$ are used as etching gas to etch the W film selectively. Through the second etching treatment, second shape conductive layers 5025 to 5029 (first conductive layers 5025*a* to 5029*a* and second conductive layers 5025*b* to 50296) are formed. At this point, regions of the gate insulating film 5007 that are not covered with the second shape conductive layers 5025 to 5029 are further etched and thinned by about 20 to 50 nm.

The reaction of the W film and the Ta film to etching by the mixture gas of $CF_4$ and $Cl_2$ can be deduced from the vapor pressure of radical or ion species generated and of reaction products. Comparing the vapor pressure among fluorides and chlorides of W and Ta, $WF_6$ that is a fluoride of W has an extremely high vapor pressure while the others, namely, $WCl_5$, $TaF_5$, and $TaCl_5$ have a vapor pressure of about the same degree. Accordingly, the W film and the Ta film are both etched with the mixture gas of $CF_4$ and $Cl_2$. However, when an appropriate amount of $O_2$ is added to this mixture gas, $CF_4$ and $O_2$ react to each other to be changed into CO and F, generating a large amount of F radicals or F ions. As a result, the W film whose fluoride has a high vapor pressure is etched at an increased etching rate. On the other hand, the etching rate of the Ta film is not increased much when F ions are increased in number. Since Ta is more easily oxidized than W, the addition of $O_2$ results in oxidization of the surface of the Ta film. The oxide of Ta does not react with fluorine or chlorine and therefore the etching rate of the Ta film is reduced further. Thus a difference in etching rate is introduced between the W film and the Ta film, so that the etching rate of the W film is set faster than the etching rate of the Ta film.

Figure 14A:
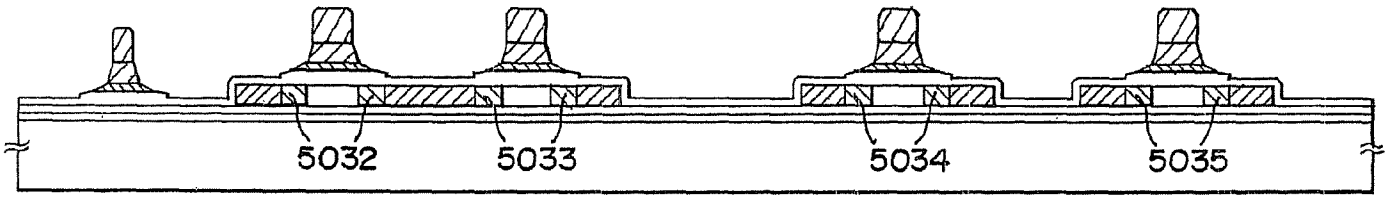
FIGS. 14A to 14C are diagrams showing the method of manufacturing a light emitting device.

Then second doping treatment is conducted as shown in FIG. 14A. In the second doping treatment, the film is doped with an impurity element that gives the n-type conductivity in a dose smaller than in the first doping treatment and at a high acceleration voltage. For example, the acceleration voltage is set to 70 to 120 keV and the dose is set to $1\times10^{13}$ atoms/cm$^2$ to form new impurity regions inside the first impurity regions that are formed in the island-like semiconductor layers in FIG. 13B. While the second shape conductive layers 5026 to 5029 are used as masks against the impurity element, regions under the first conductive layers 5026*a* to 5029*a* are also doped with the impurity element. Thus formed are third impurity regions 5032 to 5035. The third impurity regions 5032 to 5035 contain phosphorus (P) with a gentle concentration gradient that conforms with the thickness gradient in the tapered portions of the first conductive layers 5026*a* to 5029*a*. In the semiconductor layers that overlap the tapered portions of the first conductive layers 5026*a* to 5029*a*, the impurity concentration is slightly lower around the center than at the edges of the tapered portions of the first conductive layers 5026*a* to 5029*a*. However, the difference is very slight and almost the same impurity concentration is kept throughout the semiconductor layers.

Figure 14B:
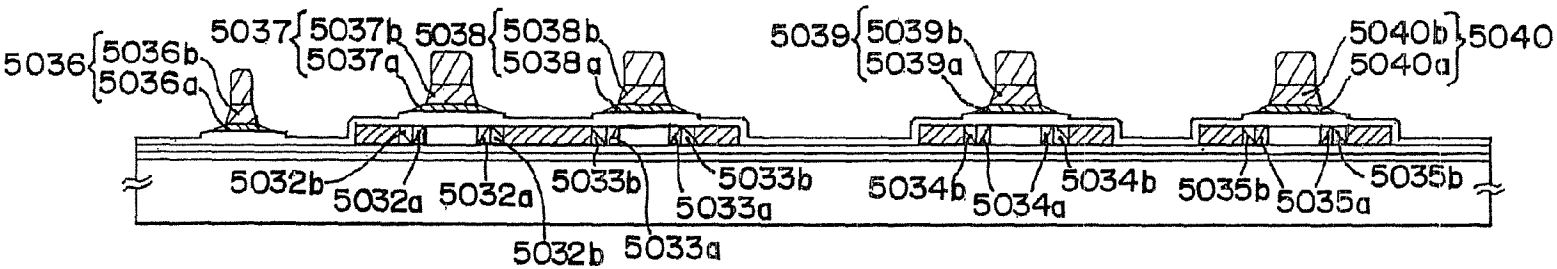

Third etching treatment is then carried out as shown in FIG. 14B. $CHF_6$ is used as etching gas, and reactive ion etching (RIE) is employed. Through the third etching treatment, the tapered portions of the first conductive layers 5025*a* to 5029*a* are partially etched to reduce the regions where the first conductive layers overlap the semiconductor layers. Thus formed are third shape conductive layers 5036 to 5040 (first conductive layers 5036*a* to 5040*a* and second conductive layers 5036*b* to 5040*b*). At this point, regions of the gate insulating film 5007 that are not covered with the third shape conductive layers 5036 to 5040 are further etched and thinned by about 20 to 50 nm.

Third impurity regions 5032 to 5035 are formed through the third etching treatment. The third impurity regions 5032 to 5035 consist of third impurity regions 5032*a* to 5035*a* that overlap the first conductive layers 5037*a* to 5040*a*, respectively, and second impurity regions 5032*b* to 5035*b* each formed between a first impurity region and a third impurity region.

Figure 14C:
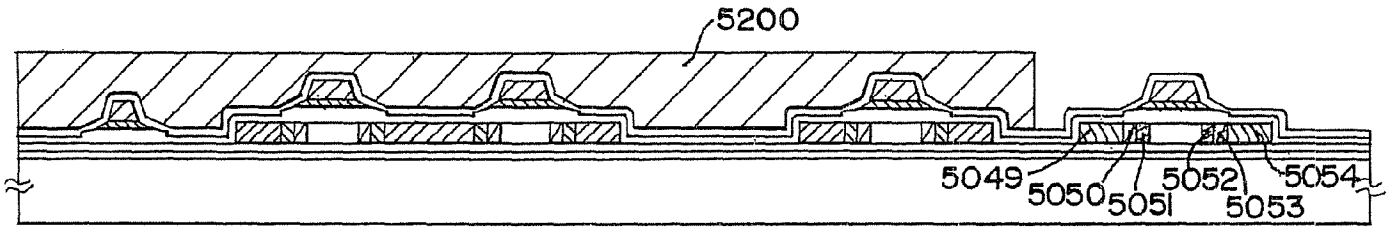

As shown in FIG. 14C, fourth impurity regions 5043 to 5054 having the opposite conductivity type to the first conductivity type are formed in the island-like semiconductor layer 5006 for forming p-channel TFTs. The third shape conductive layer 5040*b* are used as masks against the impurity element and impurity regions are formed in a self-aligning manner. At this point, the island-like semiconductor layers 5004, 5005 for forming n-channel TFTs and the wiring line 5036 are entirely covered with a resist mask 5200. The impurity regions 5049 to 5054 have already been doped with phosphorus in different concentrations. the impurity regions 5049 to 5054 are doped with diborane ($B_2H_6$) through ion doping such that diborane dominates phosphorus in each region and each region contain the impurity element in a concentration of $2\times10^{20}$ to $2\times10^{21}$ atoms/cm$^3$.

Through the steps above, the impurity regions are formed in the respective island-like semiconductor layers. The third shape conductive layers 5037 to 5040 overlapping the island-like semiconductor layers function as gate electrodes. The layers 5036 function as island-like source signal lines.

After the resist mask 5200 is removed, the impurity elements used to dope the island-like semiconductor layers in order to control the conductivity types are activated. The activation step is carried out by thermal annealing using an annealing furnace. Other activation adoptable methods include laser annealing and rapid thermal annealing (RTA). The thermal annealing is conducted in a nitrogen atmosphere with an oxygen concentration of 1 ppm or less, preferably 0.1 ppm or less, at 400 to 700° C., typically 500 to 600° C. In this embodiment, the substrate is subjected to heat treatment at 500° C. for four hours. However, if the wiring line material used for the third shape conductive layers 5036 to 5040 are weak against heat, the activation is desirably made after an interlayer insulating film (mainly containing silicon) is formed in order to protect the wiring lines and others.

In the case of that the laser annealing method is used, the laser which is used for the crystallization is possible to use. When the activation is performed, the mobile speed is made the same of that of the crystallization. The energy density is necessary about 0.01 to 100 MW/cm$^a$ (preferably 0.01 to 10 MW/cm$^2$).

Another heat treatment is conducted in an atmosphere containing 3 to 100% hydrogen at 300 to 450° C. for one to twelve hours, thereby hydrogenating the island-like semiconductor layers. The hydrogenation steps is to terminate dangling bonds in the semiconductor layers using thermally, excited hydrogen. Alternatively, plasma hydrogenation (using hydrogen that is excited by plasma) may be employed.

Figure 15A:
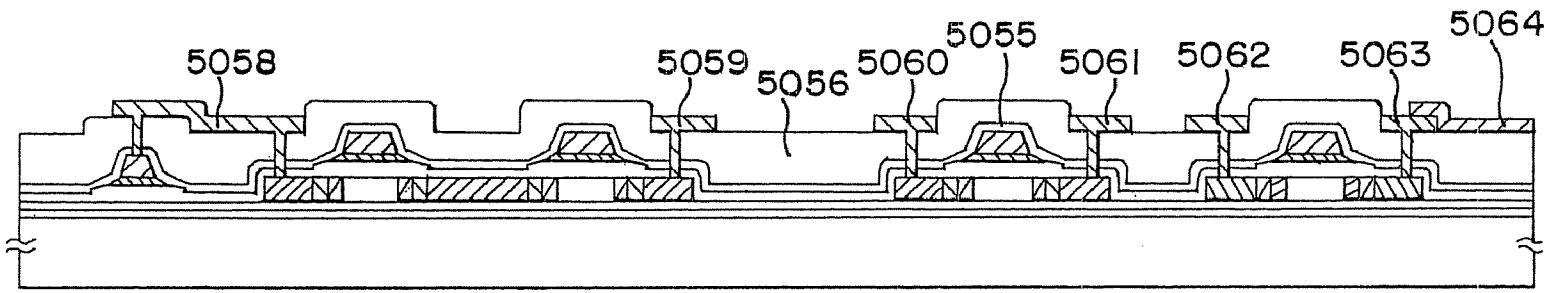
FIGS. 15A and 15B are diagrams showing the method of manufacturing a light emitting device.

As shown in FIG. 15A, a first interlayer insulating film 5055 is formed next from a silicon oxynitride film with a thickness of 100 to 200 nm. A second interlayer insulating film 5056 is formed thereon from an organic insulating material. Thereafter, contact holes are formed through the first interlayer insulating film 5055, the second interlayer insulating film 5056, and the gate insulating film 5007. Connection wiring lines 5058 to 5063 are formed by patterning. The connection wiring line (drain wiring line) 5063 is in contact with a pixel electrode 5064, which is formed by patterning. The connection wiring lines include source wiring lines and drain wiring lines. A source wiring line is a wiring line connected to a source region of an active layer and a drain wiring line is a wiring line connected to a drain region of the active layer.

The second interlayer insulating film 5056 is a film made of an organic resin. Examples of the usable organic resin includes polyimide, polyamide, acrylic resin, and BCB (benzocyclobutene). Since planarization is a significant aspect of the role of the second interlayer insulating film 5056, acrylic resin that can level the surface well is particularly preferable. In this embodiment, the acrylic film is thick enough to eliminate the level differences caused by the TFTs. An appropriate thickness of the film is 1 to 5 μm (preferably 2 to 4 μm).

The contact holes are formed by dry etching or wet etching, and include contact holes reaching the impurity regions 5017 to 5021 having the n-type conductivity or the impurity regions 5049 and 5054 having the p-type conductivity, a contact hole reaching the wiring line 5036, a contact hole (not shown) reaching a power supply line, and contact holes (not shown) reaching the gate electrodes.

The connection wiring lines 5058 to 5063 are obtained by patterning a laminate with a three-layer structure into a desired shape. The laminate consists of a Ti film with a thickness of 100 nm, a Ti-containing aluminum film with a thickness of 300 nm, and a Ti film with a thickness of 150 nm which are successively formed by sputtering. Other conductive films may of course be used.

The pixel electrode 5064 in this embodiment is obtained by patterning an 110 film with a thickness of 110 nm. A contact is made by arranging the pixel electrode 5064 so as to overlap the connection wiring line 5063. The pixel electrode may instead be formed of a transparent conductive film in which indium oxide is mixed with 2 to 20% zinc oxide (ZnO). The pixel electrode 5064 serves as an anode of an EL element. (FIG. 15A)

Figure 15B:
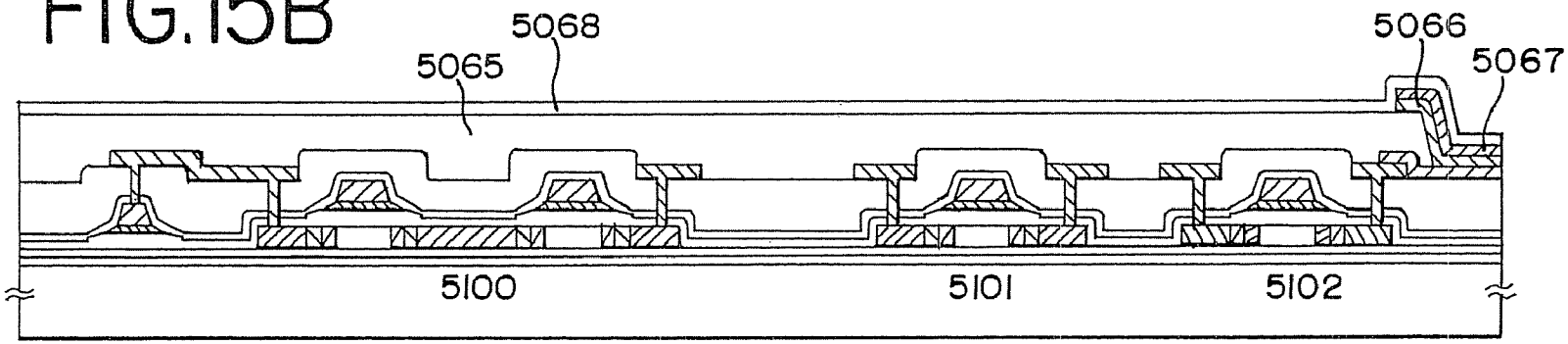

Next, as shown in FIG. 15B, an insulating film containing silicon (a silicon oxide film, in this embodiment) is formed to a thickness of 500 nm and an aperture is opened in the film at a position corresponding to the position of the pixel electrode 5064. A third interlayer insulating film 5065 functioning as a bank is thus formed. The aperture is formed using wet etching, thereby readily forming tapered side walls. If the side walls of the aperture is not smooth enough, the level difference can make degradation of an EL layer into a serious problem. Therefore attention must be paid.

An EL layer 5066 and a cathode (MgAg electrode) 5067 are formed by vacuum evaporation successively without exposing the substrate to the air. The thickness of the EL layer 5066 is set to 80 to 200 nm (typically 100 to 120 nm). The thickness of the cathode 5067 is set to 180 to 300 nm (typically 200 to 250 nm).

In this step, the EL layer and the cathode are formed in a pixel for red light, then in a pixel for green light, and then in a pixel for blue light. The EL layers have low resistivity to solutions, inhibiting the use of photolithography. Therefore an EL layer of one color cannot be formed together with an EL layer of another color. Then EL layers are selectively formed in pixels of one color while covering pixels of the other two colors with a metal mask.

To elaborate, first, a mask that covers all the pixels except pixels for red light is set and EL layers for emitting red light are selectively formed using the mask. Then a mask that covers all the pixels except pixels for green light is set and EL layers for emitting green light are selectively formed using the mask. Lastly, a mask that covers all the pixels except pixels for blue light is set and EL layers for emitting blue light are selectively formed using the mask. Although different masks are used in the description here, the same mask may be used three times for forming the EL layers of three colors.

Formed here are three types of EL elements in accordance with R, G, and B. Instead, a white light emitting EL element combined with color filters, a blue light or bluish green light emitting element combined with fluorophors (fluorescent color conversion layers: CCM). or overlapped RGB EL elements with a cathode (opposite electrode) fixated of a transparent electrode may be used.

A known material can be used for the EL layer 5066. A preferable known material is an organic material, taking the driving voltage into consideration. For example, the EL layer has a four-layer structure consisting of a hole injection layer, a hole transport layer, a light emitting layer, and an electron injection layer.

The cathode 5067 is formed next. This embodiment uses MgAg for the cathode 5067 but it is not limited thereto. Other known materials may be used for the cathode 5067.

Lastly, a passivation film 5068 is formed from a silicon nitride film with a thickness of 300 nm. The passivation film 5068 protects the EL layer 5066 from moisture and the like, thereby further enhancing the reliability of the EL element. However, the passivation film 5068 may not necessarily be formed.

Alight emitting device structured as shown in FIG. 15B is thus completed. In the process of manufacturing a light emitting device according to the present invention, the source signal lines are formed of Ta and W that are the materials of the gate electrodes whereas gate signal lines are formed of Al that is the wiring line material for forming the source and drain electrodes in consideration of circuit structure and the process. However, different materials may also be used.

The light emitting device of this embodiment exhibits very high reliability and improved operation characteristics owing to placing optimally structured TFTs in not only the pixel portion but also in the driving circuits. In the crystallization step, the film may be doped with a metal catalyst such as Ni to enhance the crystallinity. By enhancing the crystallinity, the drive frequency of the source signal line driving circuit can be set to 10 MHZ or higher.

In practice, the device reaching the state of FIG. 15B is packaged (enclosed) using a protective film that is highly airtight and allows little gas to transmit (such as a laminate film and a UV-curable resin film) or a light-transmissive seal, so as to further avoid exposure to the outside air. A space inside the seal may be set to an inert atmosphere or a hygroscopic substance (barium oxide, for example) may be placed there to improve the reliability of the EL element.

After securing the airtightness through packaging or other processing, a connector (flexible printed circuit: FPC) is attached for connecting an external signal terminal with a terminal led out from the elements or circuits formed on the substrate.

By following the process shown in this embodiment, the number of photo masks needed in manufacturing a light emitting device can be reduced. As a result, the process is cut short to reduce the manufacture cost and improve the yield.

The structure of this embodiment can be combined freely with Embodiments 1 through 6.

[Embodiment 8]

In this embodiment, an external light emitting quantum efficiency can be remarkably improved by using an EL material by which phosphorescence from a triplet exciton can be employed for emitting a light. As a result, the power consumption of the EL element can be reduced, the lifetime of the EL element can be elongated and the weight of the EL element can be lightened.

The following is a report where the external light emitting quantum efficiency is improved by using the triplet exciton (T. Tsutsui, C. Adachi, S. Saito, Photochemical processes in Organized Molecular Systems, ed. K. Honda, (Elsevier Sci. Pub., Tokyo, 1991) p. 437).

The molecular formula of an EL material (coumarin pigment) reported by the above article is represented as follows.

[Chemical Formula 1]

[Chemical Formula 1]

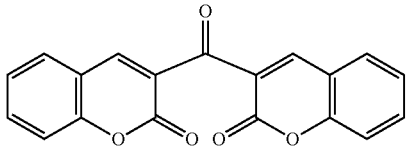

(M. A. Baldo, D.F.O'Brien, Y. You, A. Shoustikov, S. Sibley, M. E. Thompson, S. R. Forrest, Nature 395 (1998) p. 151)

The molecular formula of an EL material (Pt complex) reported by the above article is represented as follows.

[Chemical Formula 2]

[Chemical Formula 2]

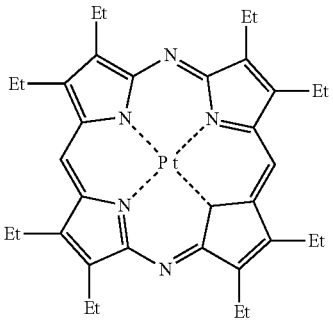

(M. A. Baldo, S. Lamansky, P. E. Burrows, M. E. Thompson, S. R. Forrest, Appl. Phys. Lett., 75 (1999) p. 4.)

(T. Tsutsui, M.-J.Yang, M. Yahiro, K. Nakamura, T. Watanabe, T. Tsuji, Y. Fukuda, T. Wakimoto, S. Mayaguchi, Jpn, Appl. Phys., 38 (12B) (1999) L1502)

The molecular formula of an EL material (Ir complex) reported by the above article is represented as follows.

[Chemical Formula 3]

[Chemical Formula 3]

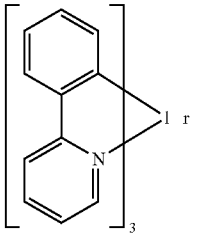

As described above, if phosphorescence from a triplet exciton can be put to practical use, it can realize the external light emitting quantum efficiency three to four times as high as that in the case of using fluorescence from a singlet exciton in principle.

The structure according to this embodiment can be freely implemented in combination of any structures of Embodiments 1 through 7.

[Embodiment 9]

Described in this embodiment is an example of adjusting a period during which an EL element emits light by correcting digital video signals based on the electric potential level of a pixel electrode which is calculated from the position of the pixel.

Figure 19:
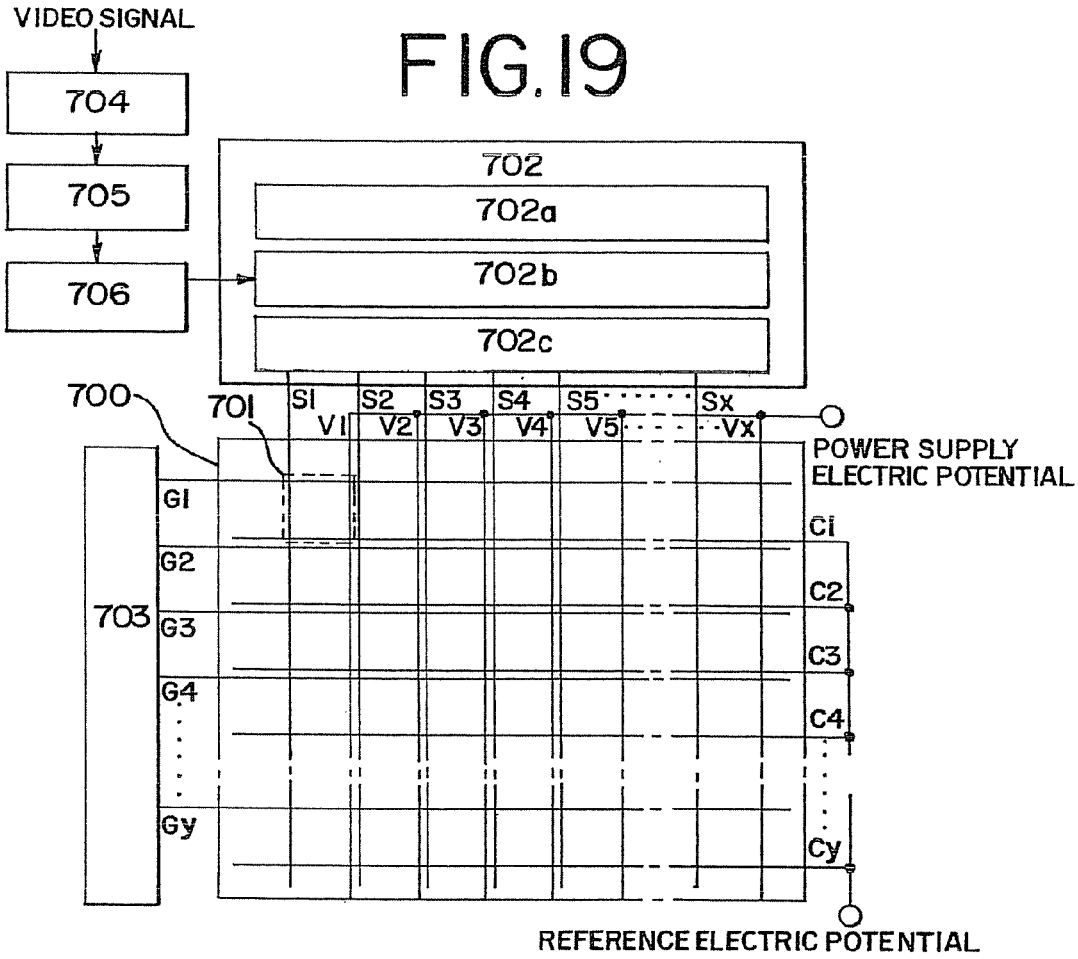
FIG. 19 is a block diagram of a light emitting device that has a Correction circuit.

FIG. 19 is a block diagram of a light emitting device according to this embodiment. A pixel portion 700 has source signal lines S1 to Sx, power supply lines V1 to Vx, gate signal lines G1 to Gy, and reference power supply lines C1 to Cy.

A region that has one of the source signal lines S1 to Sx, one of the power supply lines V1 to Vx, one of the gate signal lines G1 to Gy, and one of the reference power supply lines C1 to Cy corresponds to a pixel 701.

The light emitting device of the present invention has as a driving circuit a source signal line driving circuit 702 and a gate signal line driving circuit 703. Although the light emitting device shown in FIG. 19 has one source signal line driving circuit 702 and one gate signal line driving circuit 703, this embodiment is not limited thereto. The device may have two or more source signal line driving circuits and two or more gate signal line driving circuits. These driving circuits may be formed on the same substrate on which the pixel portion 700 is formed or may be formed on a different substrate which is connected to a substrate with the pixel portion through a connector such as an FPC.

The light emitting device of the present invention also has a correction circuit 704, a VRAM 705, and a digital video signal generating circuit 706.

Video signals inputted from the external to the EL panel are inputted to the correction circuit 704. When the video signals are digital signals, they are inputted to the correction circuit 704 as they are. When the video signals are analog signals, they are converted into digital signals before or after inputted to the correction circuit 704.

The correction circuit 704 corrects the inputted video signals in accordance with the following Equation 1.

$$L_{out}=L_{in}\times(\beta+\alpha\times\text{gate number}) \quad \text{(Equation 1)}$$

wherein $L_{in}$ represents the number of gray scales which the signals inputted to the correction circuit 704 carry as information, and $L_{out}$ represents the number of gray scales which the signals outputted from the correction circuit 704 carry as information.

$\alpha$ and $\beta$ are constant number. $\alpha$ is a constant (correction coefficient) determined by the wiring line resistance and by the amount of current flowing into the EL element when the EL driving TFT is turned ON. $\beta$ is a constant representing the number of gray scales of pixels in assuming that the wiring line resistance is zero. The gate number is a number allotted to a gate signal line. The gate signal line of the pixels which are the closest to the power supply of the power supply line is a gate signal line No. 1, and the gate number ascends as gate signal lines farther from the power supply.

Figure 20:
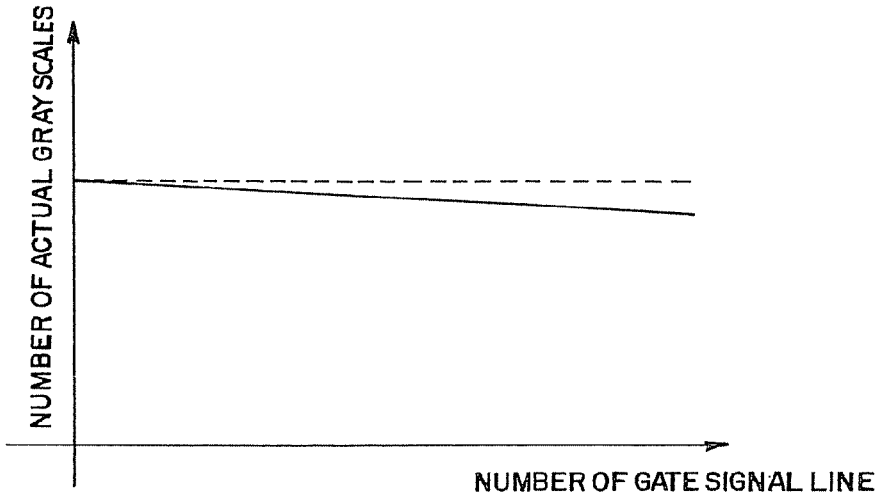
FIG. 20 is a graph showing the number of gray scales before correction based on the pixel position and the number of gray scales after the correction.

FIG. 20 shows the number of actual gray scales (solid line) of pixels, which have the respective gate signal lines, without correction in the correction circuit 704 and the number of actual gray scales (dotted line) of pixels, which have the respective gate signal lines, with correction in the correction circuit 704. The solid line shows that the number of gray scales actually reflected on the screen decreases as the gate signal line number ascends and the distance between the pixel and the power supply of the power supply line increases. On the other hand, the dotted line shows that the correction by the correction circuit 704 makes the number of gray scales constant for all of the pixels.

Video signals (post-correction video signals) that carry as information the number of gray scales $L_{out}$ calculated from Equation 1 are temporarily stored in the VRAM 705 and then inputted to the digital video signal generation circuit 706.

The digital video signal generation circuit 706 converts the post-correction video signals into digital video signals for time ratio gray scale, and the digital video signals are inputted to a latch A 702*b*. The digital video signal generation circuit 706 also generates timing pulses and others which are necessary for time ratio gray scale display.

The digital video signal generation circuit 706 may be external to the light emitting device of the present invention. In this case, digital video signals generated in the circuit are inputted to the light emitting device of the present invention. Then an electronic device that employs the light emitting device of the present invention as its display unit has the light emitting device of the present invention and the digital video signal generation circuit as separate parts.

The digital video signal generating circuit 706 may be formed on an IC chip to mount the chip to the light emitting device of the present invention. In this case, digital video signals generated in the IC chip are inputted to the light emitting device of the present invention. Then an electronic device that employs the light emitting device of the present invention for its display unit has as its part the light emitting device of the present invention into which the IC chip including the digital video signal generation circuit is mounted.

The digital video signal generating circuit 706 may be formed using a TFT on the same substrate on which the pixel portion 700, the source signal line driving circuit 702, and the gate signal line driving circuit 703 are formed. In this case, once video signals carrying image information are inputted to the light emitting device, all of processing can be conducted on the substrate. The TFT used to construct the digital video signal generating circuit can choose a polysilicon film for its active layer. Then an electronic device that employs the light emitting device of the present invention for its display can be reduced in size since the digital video signal generation circuit is built in the light emitting device of the present invention.

The digital video signals outputted from the digital video signal generating circuit 706 are inputted to the latch A 702*b* of the source signal line driving circuit 702.

The source signal line driving circuit 702 has a shift register 702*a*, the latch A 702*b*, and a latch B 702*c*.

In the source signal line driving circuit 702, clock signals (CLK) and start pulses (SP) are inputted to the shift register 702*a*. The shift register 702*a* sequentially generates timing signals in response to these clock signals (CLK) and start pulses (SP), and the timing signals are sequentially inputted to downstream circuits though a buffer (not shown in the drawing) or the like.

The timing signals from the shift register 702*a* are buffered and amplified by a buffer or the like. A wiring line to which the timing signals are to be inputted is connected to many circuits or elements and bears a large load capacitance (parasitic capacitance). The large load capacitance dulls the rise or fall of the timing signals. The buffer is provided to avoid dulled rising or falling of the timing signals but its inclusion may not always be necessary.

The timing signals buffered and amplified by the buffer are inputted to the latch circuit A 702*b*. The latch A 702*b* has a plural stages of latches for processing n bit digital video signals. As the timing signals are inputted, the latch A 702*b* sequentially receives n bit digital video signals inputted from the digital video signal generating circuit 706 to hold the video signals therein.

When the digital video signals are inputted to the latch A 702*b*, the digital video signals may be sequentially inputted to the plural stages of latches of the latch A 702*b*. However, the present invention is not limited thereto. The invention may employ a so-called division driving in which the plural stages of lathes of the latch A 702*b* are divided into a few groups and the digital video signals are inputted to the respective groups simultaneously. The number of groups in division driving is referred to as number of division.

The time required for completing writing digital video signals once into all stages of latches of the latch A 702*b* is called a line period. Actually, sometimes the line period defined as the above plus a horizontal retrace period are regarded as a line period.

Upon completion of one line period, latch signals are inputted to the latch B 702*c*. At this instant, the digital video signals that have been written and held in the latch A 702*b* are sent to the latch B 702*c* all at once to be written and held in plural stages of latches of the latch B 702*c*.

Having sent the digital video signals to the latch B 702*c*, the latch A 702*b* now receives the next supply of digital video signals so that the digital video signals are sequentially written in response to timing signals from the shift register 702*a*.

When one line period is thus started for the second time, the digital video signals written and held in the latch B 702*c* are inputted to the source signal line.

The gate signal line driving circuit 703 has a shift register (not shown) and a buffer (not shown). In some cases, the gate signal line driving circuit may have a level shifter.

In the gate signal line driving circuit 703, timing signals from the shift register are inputted to the buffer and then to associated gate signal lines. One gate signal line is connected to gate electrodes of switching TFTs of one line of pixels. Since the switching TFTs of one line of pixels have to be turned ON all at once, the buffer used is capable of causing a large amount of current to flow.

The present invention employs the correction circuit to obtain the same gray scale even when positions of pixels create difference in luminance between EL elements.

The structure of this embodiment can be combined with any of structures of Embodiments 1 through 8.

[Embodiment 10]

A light emitting device using an EL element is self-luminous and therefore is superior in visibility in bright surroundings compared to liquid crystal display devices and has wider viewing angle. Accordingly, it can be used for display units of various electronic devices.

Examples of electronic devices employing a light emitting device of the present invention is are: a video camera; a digital camera; a goggle type display (head mounted display); a navigation system; an audio reproducing device (car audio, an audio component, and the like); a notebook computer, a game machine; a portable information terminal (a mobile computer, a cellular phone, a portable game machine, an electronic book, etc.); and an image reproducing device (specifically, a device capable of processing data in a recording medium such as a digital versatile disk (DVD) and having a display device that can display the image of the data). The light emitting device having an EL element is desirable particularly for a portable information terminal since its screen is often viewed obliquely and is required to have a wide viewing angle. Specific examples of the electronic devices are shown in FIGS. 16A to 16H.

Figure 16A:
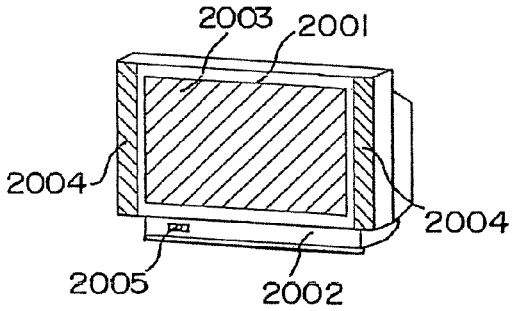
FIGS. 16A to 16H are diagrams of electronic devices that employ a light emitting device of the present invention.

FIG. 16A shows an EL display device, which is composed of a casing 2001, a supporting base 2002, a display unit 2003, speaker units 2004, a video input terminal 2005, etc. The light emitting device of the present invention is applied can be used for the display unit 2003. The light emitting device having an EL element is self-luminous and does not need a backlight, so that it can make a thinner display unit than liquid display devices can. The term EL display device includes every display device for displaying information such as one for a personal computer, one for receiving TV broadcasting, and one for advertisement.

Figure 16B:
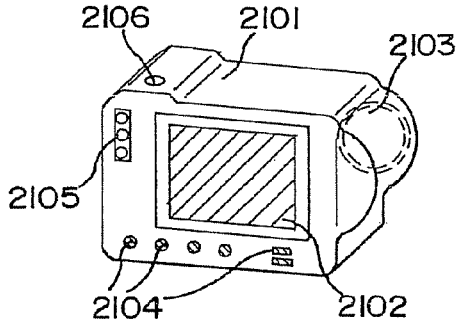

FIG. 16B shows a digital still camera, which is composed of a main body 2101, a display unit 2102, an image receiving unit 2103, operation keys 2104, an external connection port 2105, a shutter 2106, etc. The light emitting device of the present invention is applied can be used for the display unit 2102.

Figure 16C:
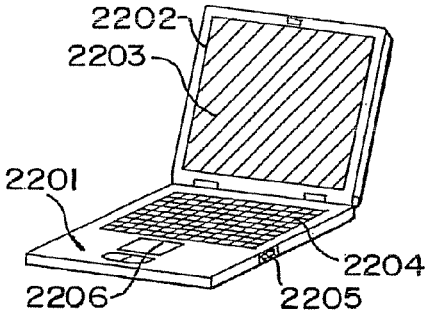

FIG. 16C shows a notebook computer, which is composed of a main body 2201, a casing 2202, a display unit 2203, a keyboard 2204, an external connection port 2205, a pointing mouse 2206, etc. The light emitting device of the present invention is applied can be used for the display unit 2203.

Figure 16D:
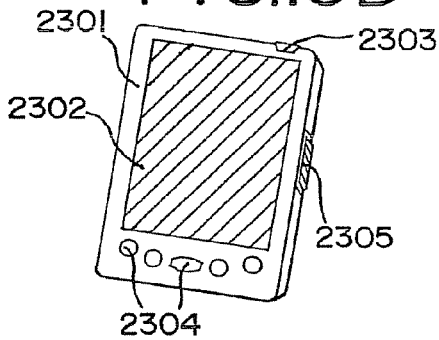

FIG. 16D shows a mobile computer, which is composed of a main body 2301, a display unit 2302, a switch 2303, operation keys 2304, an infrared ray port 2305, etc. The light emitting device of the present invention is applied can be used for the display unit 2302.

Figure 16E:
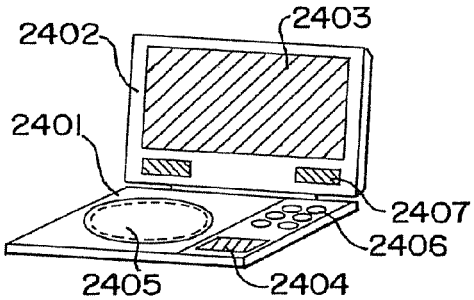

FIG. 16E shows a portable image reproducing device equipped with a recording medium (a DVD player, to be specific). The device is composed of a main body 2401, a casing 2402, a display unit A 2403, a display unit B 2404, a recording medium (DVD) reading unit 2405, operation keys 2406, speaker units 2407, etc. The display unit A 2403 mainly displays image information whereas the display unit B 2404 mainly displays text information. The light emitting device to which the repairing method of the present invention is applied can be used for the display units A 2403 and B 2404. The term image reproducing device equipped with a recording medium includes video game machines.

Figure 16F:
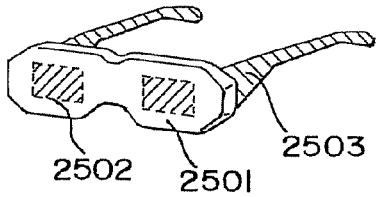

FIG. 16F shows a goggle type display (head mounted display), which is composed of a main body 2501, display units 2502, and arm units 2503. The light emitting device of the present invention is applied can be used for the display units 2502.

Figure 16G:
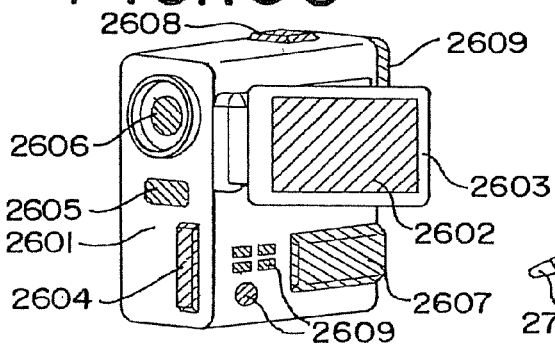

FIG. 16G shows a video camera, which is composed of a main body 2601, a display unit 2602, a casing 2603, an external connection port 2604, a remote control receiving unit 2605, an image receiving unit 2606, a battery 2607, an audio input unit 2608, operation keys 2609, etc. The light emitting device of the present invention is applied can be used for the display unit 2602.

Figure 16H:
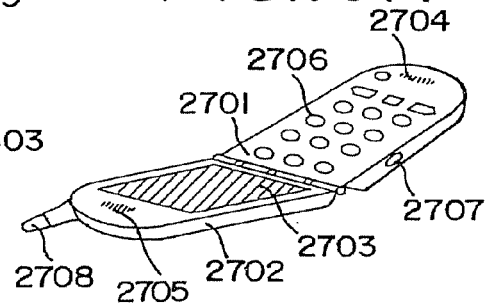
Figure 17:
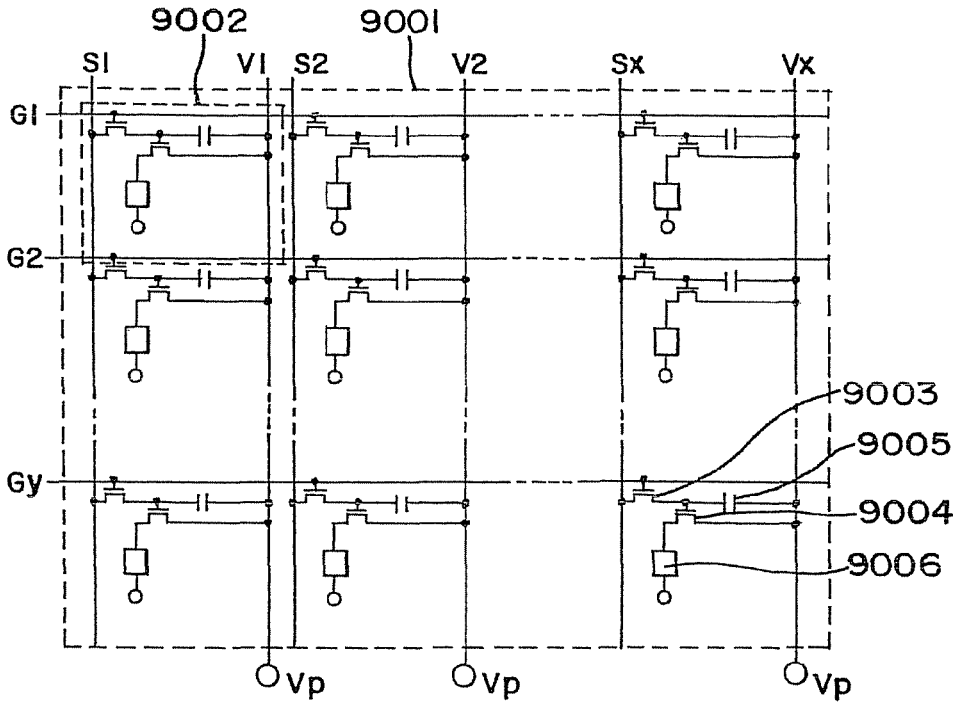
FIG. 17 is a circuit diagram of a pixel portion in a common light emitting device.
Figure 18A:
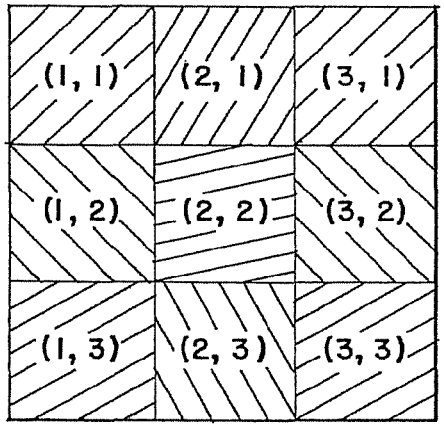
FIGS. 18A and 18B are diagrams of a pixel portion in which crosstalk is taking place.
Figure 18B:
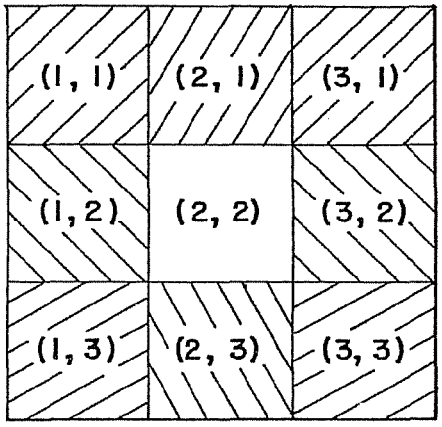

FIG. 16H shows a cellular phone, which is composed of a main body 2701, a casing 2702, a display unit 2703, an audio input unit 2704, an audio output unit 2705, operation keys 2706, an external connection port 2707, an antenna 2708, etc. The light emitting device to which the repairing method of the present invention is applied can be used for the display unit 2703. If the display unit 2703 displays white characters on a black background, power consumption of the cellular phone can be reduced.

If the luminance of light emitted from EL materials is increased in future, the light emitting device having an EL element can be used also in a front or rear projector in which light bearing outputted image information is magnified by a lens or the like to be projected on a screen.

The electronic device given in the above often displays information distributed through electronic communication lines such as Internet and CATV (cable television), especially, animation information with increasing frequency. The light emitting device having an EL element is suitable for displaying animation information since EL materials have fast response speed.

In the light emitting device, portions that emit light consume power. Therefore it is desirable to display information such that as small portions as possible emit light. Accordingly, if the light emitting device is used for a display unit that mainly displays text information such as a portable information terminal, in particular, a cellular phone, and an audio reproducing device, it is desirable to assign light emitting portions to display text information while portions that do not emit light serve as the background.

As described above, the application range of the light emitting device to which the present invention is applied is very wide and electronic devices of every field can employ the device. The electronic devices in this embodiment may use any of the structures shown in Embodiments 1 through 9.

With the above structure, variation of the difference in electric potential over the length of a power supply line depending on an image to be displayed is contained: Thus reduced is the difference in amount of current flowing into EL elements in adjacent pixels during the EL elements emit light, thereby avoiding crosstalk.

According to the present invention, the difference in electric potential over the length of a power supply line is independent of images to be displayed. Therefore the level of electric potential of a pixel electrode of an EL element can be deduced solely by the position of the pixel. Then, based on the level of electric potential of the pixel electrode which is calculated from the position of the pixel, a digital video signal is corrected and a period during which the EL element emits light is adjusted. In this way, even if difference in luminance between EL elements due to positions of their pixels is caused, the pixels can provide the same gray scale.

What is claimed is:

1. A light emitting device comprising:

a first TFT comprising a gate, a first terminal and a second terminal;

a second TFT comprising a gate, a first terminal and a second terminal, wherein one of the first terminal and the second terminal of the second TFT is electrically connected to one of the first terminal and the second terminal of the first TFT;

a third TFT comprising a gate, a first terminal and a second terminal, wherein one of the first terminal and the second terminal of the third TFT is electrically connected to the other of the first terminal and the second terminal of the second TFT; and an electrode of an EL element, the electrode being electrically connected to the other of the first terminal and the second terminal of the third TFT, wherein the other of the first terminal and the second terminal of the second TFT is electrically connected to the gate of the second TFT, and wherein the gate of the first TFT is electrically connected to the gate of the third TFT.

2. The light emitting device according to claim 1, wherein the other of the first terminal and the second terminal of the second TFT is directly connected to the gate of the second TFT.

3. The light emitting device according to claim 1, further comprising a second power supply line, wherein the second power supply line is electrically connected to the other of the first terminal and the second terminal of the second TFT, and wherein the second power supply line is electrically connected to the one of the first terminal and the second terminal of the third TFT.

4. The light emitting device according to claim 1, wherein the first TFT is an n-channel TFT, and wherein the second TFT is an n-channel TFT.

5. The light emitting device according to claim 1, further comprising:

a fourth TFT comprising a gate, a first terminal and a second terminal; and a gate signal line electrically connected to the gate of the fourth TFT, wherein the gate of the first TFT is electrically connected to one of the first terminal and the second terminal, and wherein the gate of the third TFT is electrically connected to the one of the first terminal and the second terminal.

6. A light emitting device comprising:

a first TFT comprising a gate, a first terminal and a second terminal;

a second TFT comprising a gate, a first terminal and a second terminal, wherein one of the first terminal and the second terminal of the second TFT is electrically connected to one of the first terminal and the second terminal of the first TFT;

a third TFT comprising a gate, a first terminal and a second terminal, wherein one of the first terminal and the second terminal of the third TFT is electrically connected to the other of the first terminal and the second terminal of the second TFT;

an electrode of an EL element, the electrode being electrically connected to the other of the first terminal and the second terminal of the third TFT; and a power supply line electrically connected to the other one of the first terminal and the second terminal of the first TFT, wherein the other of the first terminal and the second terminal of the second TFT is electrically connected to the gate of the second TFT, and wherein the gate of the first TFT is electrically connected to the gate of the third TFT.

7. The light emitting device according to claim 6, wherein the power supply line is electrically connected to the other one of the first terminal and the second terminal of the first TFT through a fourth TFT.

8. The light emitting device according to claim 6, wherein the other of the first terminal and the second terminal of the second TFT is directly connected to the gate of the second TFT.

9. The light emitting device according to claim 6, further comprising a second power supply line, wherein the second power supply line is electrically connected to the other of the first terminal and the second terminal of the second TFT, and wherein the second power supply line is electrically connected to the one of the first terminal and the second terminal of the third TFT.

10. The light emitting device according to claim 6, wherein the first TFT is an n-channel TFT, and wherein the second TFT is an n-channel TFT.

11. The light emitting device according to claim 6, further comprising:

a fourth TFT comprising a gate, a first terminal and a second terminal; and a gate signal line electrically connected to the gate of the fourth TFT, wherein the gate of the first TFT is electrically connected to one of the first terminal and the second terminal, and wherein the gate of the third TFT is electrically connected to the one of the first terminal and the second terminal.

12. A module comprising an EL panel, the EL panel comprising:

a first TFT comprising a gate, a first terminal and a second terminal;

a second TFT comprising a gate, a first terminal and a second terminal, wherein one of the first terminal and the second terminal of the second TFT is electrically connected to one of the first terminal and the second terminal of the first TFT;

a third TFT comprising a gate, a first terminal and a second terminal, wherein one of the first terminal and the second terminal of the third TFT is electrically connected to the other of the first terminal and the second terminal of the second TFT; and an electrode of an EL element, the electrode being electrically connected to the other of the first terminal and the second terminal of the third TFT, wherein the other of the first terminal and the second terminal of the second TFT is electrically connected to the gate of the second TFT, and wherein the gate of the first TFT is electrically connected to the gate of the third TFT.

13. The module according to claim 12, wherein the other of the first terminal and the second terminal of the second TFT is directly connected to the gate of the second TFT.

14. The module according to claim 12, further comprising a second power supply line, wherein the second power supply line is electrically connected to the other of the first terminal and the second terminal of the second TFT, and wherein the second power supply line is electrically connected to the one of the first terminal and the second terminal of the third TFT.

15. The module according to claim 12, wherein the first TFT is an n-channel TFT, and wherein the second TFT is an n-channel TFT.

16. The module according to claim 12, further comprising:

a fourth TFT comprising a gate, a first terminal and a second terminal; and a gate signal line electrically connected to the gate of the fourth TFT, wherein the gate of the first TFT is electrically connected to one of the first terminal and the second terminal, and wherein the gate of the third TFT is electrically connected to the one of the first terminal and the second terminal.

17. The module according to claim 12, further comprising an IC mounted on the EL panel.

18. A module comprising:

a first TFT comprising a gate, a first terminal and a second terminal;

a second TFT comprising a gate, a first terminal and a second terminal, wherein one of the first terminal and the second terminal of the second TFT is electrically connected to one of the first terminal and the second terminal of the first TFT;

a third TFT comprising a gate, a first terminal and a second terminal, wherein one of the first terminal and the second terminal of the third TFT is electrically connected to the other of the first terminal and the second terminal of the second TFT;

an electrode of an EL element, the electrode being electrically connected to the other of the first terminal and the second terminal of the third TFT; and a power supply line electrically connected to the other one of the first terminal and the second terminal of the first TFT, wherein the other of the first terminal and the second terminal of the second TFT is electrically connected to the gate of the second TFT, and wherein the gate of the first TFT is electrically connected to the gate of the third TFT.

19. The module according to claim 18, wherein the power supply line is electrically connected to the other one of the first terminal and the second terminal of the first TFT through a fourth TFT.

20. The module according to claim 18, wherein the other of the first terminal and the second terminal of the second TFT is directly connected to the gate of the second TFT.

21. The module according to claim 18 further comprising a second power supply line, wherein the second power supply line is electrically connected to the other of the first terminal and the second terminal of the second TFT, and wherein the second power supply line is electrically connected to the one of the first terminal and the second terminal of the third TFT.

22. The module according to claim 18, wherein the first TFT is an n-channel TFT, and wherein the second TFT is an n-channel TFT.

23. The module according to claim 18, further comprising:

a fourth TFT comprising a gate, a first terminal and a second terminal; and a gate signal line electrically connected to the gate of the fourth TFT, wherein the gate of the first TFT is electrically connected to one of the first terminal and the second terminal, and wherein the gate of the third TFT is electrically connected to the one of the first terminal and the second terminal.

* * * * *

UNITED STATES PATENT AND TRADEMARK OFFICE

CERTIFICATE OF CORRECTION

PATENT NO. : 8,344,972 B2
APPLICATION NO. : 13/423176
DATED : January 1, 2013
INVENTOR(S) : Hajime Kimura It is certified that error appears in the above-identified patent and that said Letters Patent is hereby corrected as shown below:

In the Specification:

Column 2, Line 21; Change “is riot selected” to --is not selected--.
Column 4, Line 5; Change “driving A” to --driving TFTs. A--.
Column 4, Line 29; Change “art” to --are--.
Column 13, Line 1; Change “is a p-channel when the EL” to --is a p-channel TFT when EL--.
Column 19, Line 57; Change “which a sub-frame” to --which n sub-frame--.
Column 21, Line 10; Change “402” to --TFT 402--.
Column 23, Line 37; Change “IP” to --TFT--.
Column 26, Line 10; Change “a p-channel” to --a p-channel TFT.--.
Column 26, Line 41 to 42; Change “n-channel In” to --n-channel TFTs. In--.
Column 30, Line 14; Change “is out to” to --is set to--.
Column 30, Line 24; Change “the YVO,” to --the $YVO_4$--.
Column 32, Line 23; Change “then-hype” to --the n-type--.
Column 32, Line 30; Change “50296)” to --5029b)--.
Column 34, Line 53; Change “110 film” to --IT0 film--.
Column 35, Line 32; Change “fixated” to --formed--.

Signed and Sealed this
Seventeenth Day of September, 2013

Teresa Stanek Rea
*Deputy Directorof the United States Patent and Trademark Office*